US012709586B2

(12) United States Patent
Oqab et al.

(10) Patent No.: US 12,709,586 B2
(45) Date of Patent: Aug. 18, 2026

(54) SYSTEMS AND METHODS FOR CONTROLLABLE SYNTHESIS OF ENERGETIC NANOCOMPOSITES

(71) Applicant: Oqab Dietrich Induction Inc., Kitchener (CA)

(72) Inventors: Haroon B. Oqab, Kitchener (CA); George B. Dietrich, Kitchener (CA); John Z. Wen, Waterloo (CA); Jean-pierre Hickey, Waterloo (CA); Anqi Wang, Waterloo (CA); Shina Maini, Waterloo (CA)

( * ) Notice: Subject to any disclaimer, the term of this patent is extended or adjusted under 35 U.S.C. 154(b) by 0 days.

(21) Appl. No.: 18/841,242

(22) PCT Filed: Feb. 27, 2023

(86) PCT No.: PCT/CA2023/050248

§ 371 (c)(1),
(2) Date: Aug. 23, 2024

(87) PCT Pub. No.: WO2023/159326

PCT Pub. Date: Aug. 31, 2023

(65) Prior Publication Data

US 2025/0188001 A1 Jun. 12, 2025

Related U.S. Application Data

(60) Provisional application No. 63/314,314, filed on Feb. 25, 2022.

(51) Int. Cl.
*C06B 45/30* (2006.01)
*C06B 21/00* (2006.01)

(52) U.S. Cl.
CPC ..... *C06B 45/30* (2013.01); *C06B 21/0008* (2013.01)

(58) Field of Classification Search
None
See application file for complete search history.

(56) References Cited

U.S. PATENT DOCUMENTS 10,858,296 B1 * 12/2020 Myrick ..... C06B 45/04
2004/0173922 A1 * 9/2004 Barnes ..... C06D 5/06 264/3.1
2014/0227548 A1 * 8/2014 Myrick ..... C10L 1/28 203/40

OTHER PUBLICATIONS

Edward L. Dreizin, "Metal-based reactive nanomaterials", Progress in Energy and Combustion Science, Nov. 30, 2008 (Nov. 31, 2008), vol. 35, pp. 141-167.

(Continued)

*Primary Examiner* — Aileen B Felton
(74) *Attorney, Agent, or Firm* — Own Innovation Inc.; James W. Hinton

(57) ABSTRACT

Provided are systems and methods for synthesis of metastable intermolecular composites, specifically energetic nanocomposites. The method may include dispersing a reductive fuel within a first aqueous solution and combining the reductive fuel solution with a second aqueous solution comprising a metal oxide and base to create a reductive fuel-metal oxide/base solution. The reductive fuel-metal oxide/base solution is mixed and solid material is filtered and collected from the mixture. The solid material is heated to obtain reductive fuel-metal oxide energetic nanocomposites. The ratio of base to metal oxide can be varied to achieve different structures of including core-shell or well-mixed nanocomposites. The reductive fuel may be aluminum nanoparticles, the metal oxide may be copper oxide, and the base may be ammonia. The method can be used for mass production of energetic nanocomposites and the structure of the energetic nanocomposites can be varied to tune the energetic performance of the energetic nanocomposites.

20 Claims, 13 Drawing Sheets

(56) References Cited

OTHER PUBLICATIONS

International Search Report and Written Opinion issued on May 12, 2023 on PCT International Patent Application No. PCT/CA2023/050248.

* cited by examiner

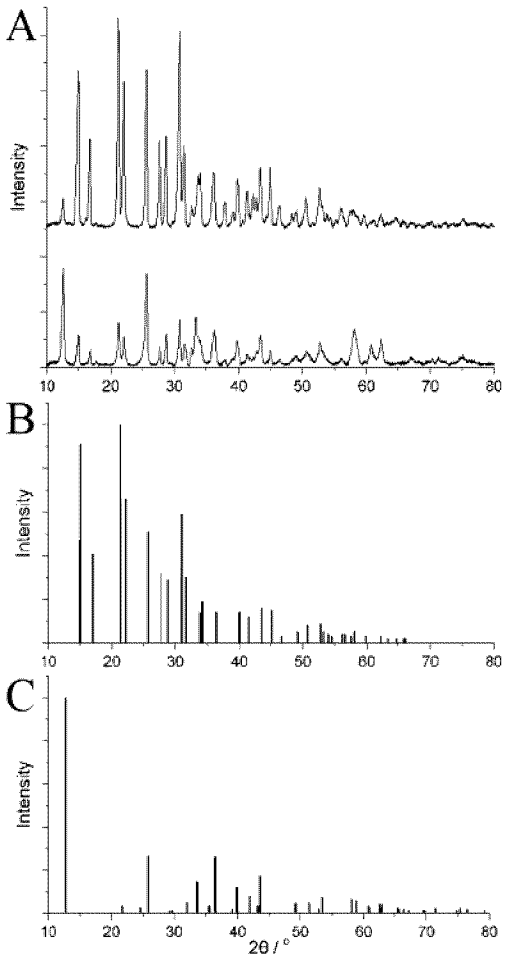
FIG. 9A, B, and C

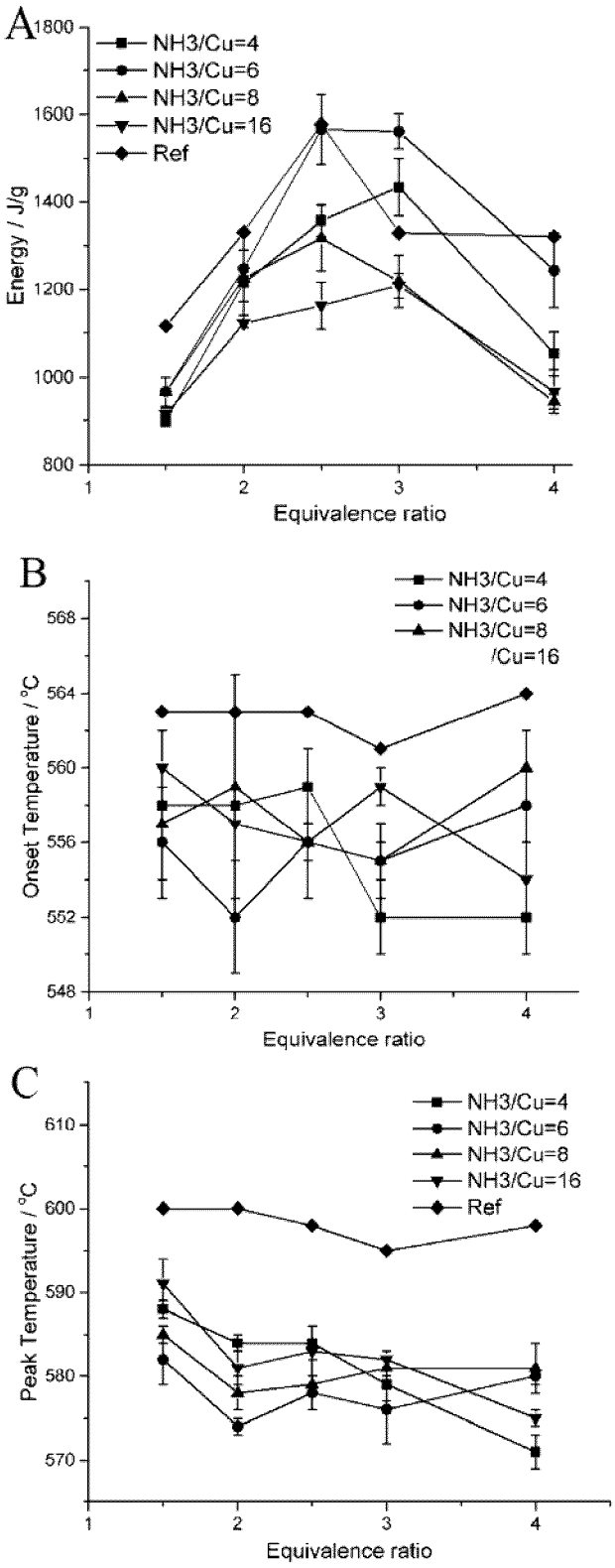
FIG. 11A, B, and C

SYSTEMS AND METHODS FOR CONTROLLABLE SYNTHESIS OF ENERGETIC NANOCOMPOSITES

TECHNICAL FIELD

The embodiments disclosed herein relate to metastable intermolecular composites and, in particular to systems and methods for the controllable synthesis of varying structures of energetic nanocomposites.

INTRODUCTION

Metastable intermolecular composites (MICs), an important type of energetic material, usually consist of a reductive fuel, such as aluminum (Al), magnesium, silicon, boron, and an oxidizer, including metal oxides and halogen composites. The redox reaction between fuel and oxidizer generates a considerable amount of heat and pressure, which can be leveraged in many applications. With the advances in nanotechnology, nanoscale MICs have gained great interest. Compared to traditional micron-sized or larger MICs, nanoscale MIC material features a greater surface area of fuel and oxidizer nanoparticles, enhancing the surface contact while shortening the diffusion length between fuel and oxidizer, thus reducing the ignition delay. The microstructure and subsequent energetic performance of metastable intermolecular composites (MICs) are predominantly determined by its fabrication process.

The extended surface are of MICs does not always result in the expected performance enhancement due to some drawbacks occurring in MIC nanocomposites. For example, the phase separation between an aluminum fuel and oxidizer significantly reduces the surface contact and the reaction rate, and also causes reactive sintering of agglomerated aluminum nanoparticles, leading to the loss of intrinsic properties of aluminum nanoparticles. Additionally, a spontaneously formed alumina shell on the surface of aluminum nanoparticles prevents direct contact between the aluminum core and oxidizer nanoparticles, which increases the energy barrier for triggering the reaction. The presence of an inert shell between aluminum fuel and oxidizer also significantly complexifies the reaction mechanism of aluminum-based MICs, which is yet to be confirmed. Moreover, the extreme sensitivity of aluminum nanoparticles to external stimulus including electrical static discharge and mechanical shock, limits the bulk production, transportation, and safe application of MICs.

Researchers have developed various structures and synthesis routes to overcome these drawbacks of nano-energetic composites. Marin et al. applied magnetron sputtering to deposit multi-layered Al/CuO nanolaminates with reduced reaction temperature and enhanced safety measures by avoiding loose MIC powder during the synthesis. However, this process only produces a very small quantity of material with a limited combustion rate. A self-assembly method has been considered as a possible method of bulk fabrication of MICs with improved homogeneity, thus increasing the reactivity of the final product. Self-assembled MICs have demonstrated better homogeneity and enhanced surface contact between fuel and oxidizer, improving the reactivity of the fabricated nano-energetic.

Among the different types of nano-scale MICs, the core-shell structure maximizes the surface contact between fuel and oxidizer. Either a reductive fuel or an oxidizer in various shapes can be employed as the core material, which is then fully covered by the other component to form a core-shell structure. The core-shell structure provides a complete reactive system. Various core-shell structured MICs, such as Al/PTFE, $Co_3O_4$/Al, and $NiCo_2O_4$/Al have been developed. However, Al/PTFE has a relatively slow reaction speed due to the decomposition kinetics of fluoropolymer, while nanowires like $Co_3O_4$/Al and $NiCo_2O_4$/Al require magnetron sputtering for the deposition of Al, preventing its bulk production. Deng et al. reported a precipitation method and a displacement method to synthesize closely packed well-distributed and core-shell micron-Al/CuO MICs. The significantly shortened diffusion length between fuel and oxidizer significantly reduced ignition delay and reaction onset temperature, as well as increased heat release. A one-pot synthesis of spherical Al/CuO core-shell structure using the wet chemistry method has also been performed. A copper ammonia complex layer was first formed onto the surface of Al micron-sized particles and then calcinated to obtain a CuO shell, producing well-coated Al/CuO core-shell particles. In contrast to other core-shell MICs, spherical Al/CuO nanoparticles possess attractive properties such as mobility and compatibility to form energy-carrying colloids in fluidic systems.

However, there is still a need for methods of synthesis of MICs which enable bulk production while maintaining energetic performance of the composites.

SUMMARY

Provided herein is a method for the controllable synthesis of energetic nanocomposites. The method includes dispersing a reductive fuel within a first aqueous solution to create a reductive fuel solution, combining a metal oxide and a base as a second aqueous solution, at a specific ratio of metal oxide to base, to create a metal oxide-base complex solution, mixing the reductive fuel solution and the metal oxide-base complex solution together to create a reductive fuel-metal oxide/base solution, filtering precipitated solid material from the reductive fuel-metal oxide/base solution, and heating the solid material to obtain reductive fuel-metal oxide energetic nanocomposites, wherein the structure and energetic performance characteristics of the reductive fuel-metal oxide energetic nanocomposites depend on the specific ratio of the metal oxide-base in the metal oxide-base complex solution.

According to some embodiments, the specific ratio may be a first ratio wherein the base may be in excess of the metal oxide and wherein the reductive fuel-metal oxide energetic nanocomposites have a core-shell structure, where the reductive fuel may be the core and the metal oxide may be the shell.

According to some embodiments, the specific ratio may be a second ratio wherein the base in not in excess of the metal oxide and wherein the reductive fuel-metal oxide energetic nanocomposites have a well-mixed structure.

According to some embodiments, the reductive fuel may be aluminum nanoparticles, the metal oxide may be copper oxide, the base may be ammonia, the first aqueous solution may be ethanol, and/or the metal oxide may be provided as an oxide precursor.

According to some embodiments, the metal oxide and/or the reductive fuel may be sourced from regolith.

Provided herein is a system for the controllable synthesis of energetic nanocomposites. The system may include a disperser to disperse reductive fuel within a first aqueous solution to create a reductive fuel solution, a mixer to mix the reductive fuel solution with a metal oxide-base complex solution to create a reductive fuel-metal oxide/base solution, wherein a specific ratio of metal oxide to base can be altered, a filter to collect solid material from the reductive fuel-metal oxide/base solution, and a heat source to heat the solid material to obtain reductive fuel-metal oxide energetic nanocomposites, wherein a structure of the reductive fuel-metal oxide energetic nanocomposites depends on the ratio of the metal oxide-base in the metal oxide-base complex solution.

According to some embodiments, the specific ratio may be a first ratio wherein the base may be in excess of the metal oxide and wherein the reductive fuel-metal oxide energetic nanocomposites have a core-shell structure where the reductive fuel may be the core and the metal oxide may be the shell.

According to some embodiments, the specific ratio may be a second ratio wherein the base in not in excess of the metal oxide and wherein the reductive fuel-metal oxide energetic nanocomposites have a well-mixed structure.

According to some embodiments, the reductive fuel may be aluminum nanoparticles, the metal oxide may be copper oxide, the base may be ammonia, the first aqueous solution may be ethanol, and/or the metal oxide may be provided as an oxide precursor.

According to some embodiments, the metal oxide and/or the reductive fuel may be sourced from regolith.

Other aspects and features will become apparent, to those ordinarily skilled in the art, upon review of the following description of some exemplary embodiments.

BRIEF DESCRIPTION OF THE DRAWINGS

The drawings included herewith are for illustrating various examples of articles, methods, and apparatuses of the present specification. In the drawings:

FIGS. 8A-E show Al/CuO core-shell nanoparticles at ER=2.5 and $NH_3$/Cu=4. FIGS. 8F-J show Al/CuO core-shell nanoparticles at ER=2.5 and $NH_3$/Cu=16.

FIG. 9 is a series of X-ray diffraction (XRD) spectra of various copper compounds.

FIG. 11A is a graph of energy release by Al/CuO core-shell nanoparticles at different equivalence ratios and $NH_3$/Cu ratios, according to an embodiment.

FIG. 11B is a graph of onset temperature by Al/CuO core-shell nanoparticles at different equivalence ratios and $NH_3$/Cu ratios, according to an embodiment.

FIG. 11C is a graph of peak temperature of major exothermic peak by Al/CuO core-shell nanoparticles at different equivalence ratios and $NH_3$/Cu ratios, according to an embodiment.

DETAILED DESCRIPTION

Figure 1A:
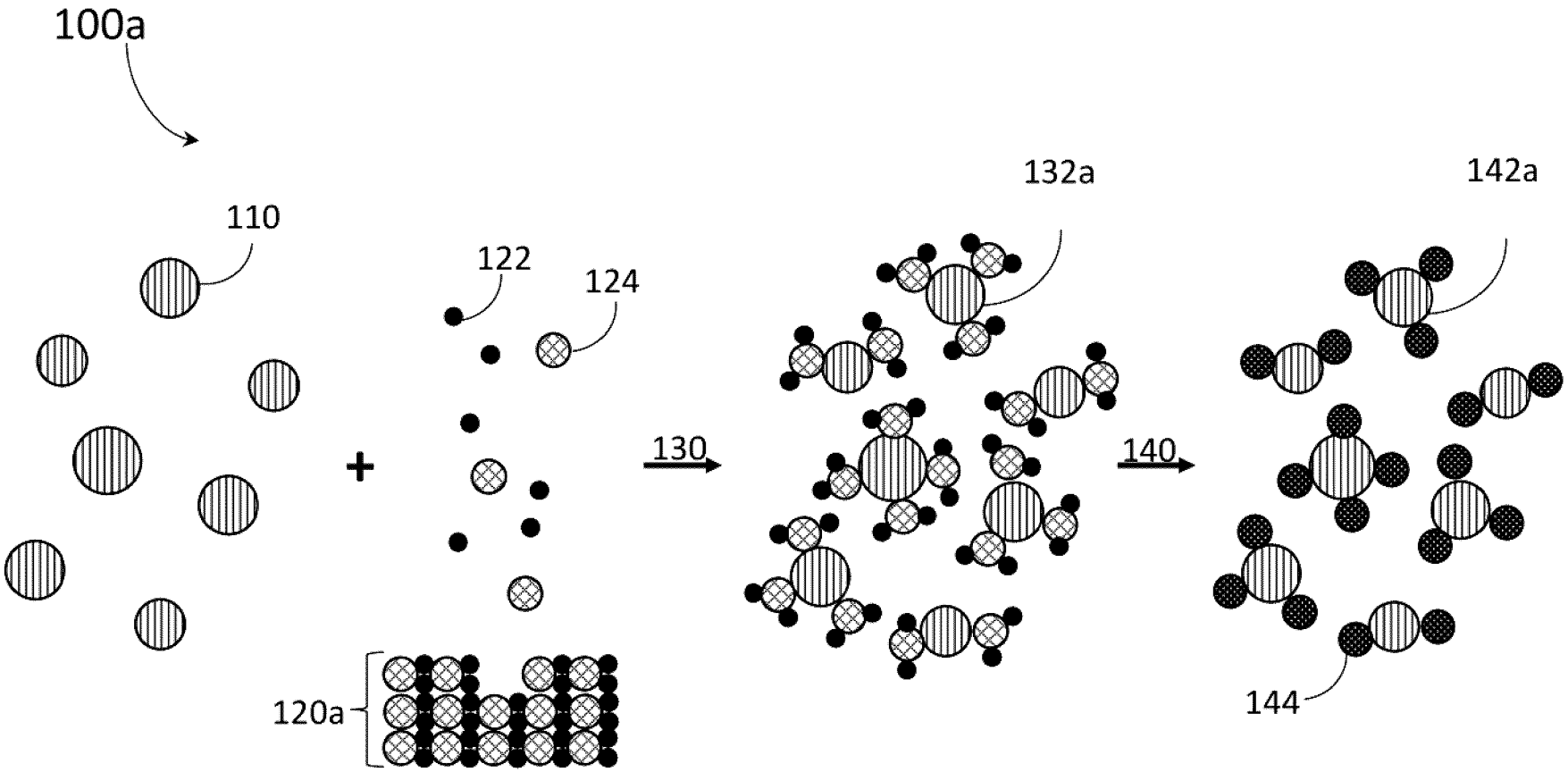
FIG. 1A is a schematic diagram of a method of controllable synthesis of nanoparticle metastable intermolecular composites using a reductive fuel, an metal oxide, and a base, according to a first embodiment.

Various apparatuses or processes will be described below to provide an example of each claimed embodiment. No embodiment described below limits any claimed embodiment and any claimed embodiment may cover processes or apparatuses that differ from those described below. The claimed embodiments are not limited to apparatuses or processes having all of the features of any one apparatus or process described below or to features common to multiple or all of the apparatuses described below.

Provided herein is a controllable method for synthesizing core-shell nanoparticles wherein varying the ratio of initial components enables the product of synthesis to be switched between core-shell nanoparticles and well-mixed nanocomposites. The core-shell nanoparticles and the well-mixed nanocomposites have different energetic performance characteristics. Therefore, the controllable method of synthesis allows for customization of the energetic performance of the synthesized nanoparticles to produce desirable microstructures of nanocomposite/nanoparticle. That is, by varying the ratios of the initial components, parameters such as energy release, onset temperature, and peak temperature of the reaction of the resulting synthesized nanoparticles can be tuned.

Herein "nanoparticle" may refer to metastable intermolecular composites such as AlCuO core-shell nanoparticles and to individual nanoparticles, for example, aluminum nanoparticles and copper oxide nanoparticles. Herein "nanocomposite" refers to well-mixed structures of metastable intermolecular composites, for example, AlCuO composites which do not have a core-shell structure but wherein CuO is complexed on the surface of the Al to create a composite. Herein "energetic nanocomposites" or "nanoparticle/nanocomposite" is meant to represent both the core-shell nanoparticles and the well-mixed nanocomposites.

Also described herein are specific methods and systems for controllable synthesis of energetic core-shell or well-mixed Al—CuO particles. The method described herein may be extended to other metal and metal oxides, such that Al particles with an oxide core shell or other surface structures of a metal or non-metal other than copper may be generated, or metal particles other than aluminum particles, of any material known in the art may be generated.

The method advantageously entails a wet-chemistry method which does not require any special equipment and, therefore, is a promising candidate for bulk production of MIC nanoparticles.

The method includes mixing a reductive fuel with an oxidizer, such as a metal oxide in the form of the oxide plus a base. By varying the ratio of the oxide to the base the physical characteristics and the energetic performance characteristics of the resulting reductive fuel+metal oxide MIC nanoparticles/nanocomposites can be tuned.

Patent Application WO2023019357A1 to Oqab et al., incorporated herein by reference, shows that altering the ratio of reductive fuel (metal powder) to oxide precursor (metal oxide) changes the energetic performance of the final product of synthesis, but not that altering the ratio of a base to the metal oxide changes the structure of the final product of the synthesis.

Referring to FIG. 1A, shown therein is a schematic diagram of the components of a method 100*a* of controllable synthesis of nanoparticle metastable intermolecular composites using a reductive fuel, an metal oxide, and a base, according to a first embodiment wherein the base is in excess of the metal oxide.

The method 100*a* includes mixing a reductive fuel 110 (striped circles, only one labelled to reduce clutter) (e.g., aluminum, magnesium, silicon, boron, etc.) with an metal oxide-base complex 120*a* which comprises a metal oxide (e.g., copper, nickel, iron, etc.) and a base (e.g., ammonia, organic amines). The metal oxide and base interact to form an metal oxide-base molecule, for example, if the metal oxide were copper and the base were ammonia, as described further below, the metal oxide-base molecule would be $Cu(OH)_x(NO_3)_y$. The reductive fuel 110 is dispersed within an aqueous solution and the metal oxide-base is mixed (arrow 130) into the reductive fuel aqueous solution. Within the solution the metal oxide-base complex exists as ions 122 (black circles, only one labelled to reduce clutter) and 124 (hatched circles, only one labelled to reduce clutter) which interact with the reductive fuel 110. For example, in the copper/ammonia example, the ions would be $Cu(NH_3)_4^{2+}$ and $NO_3$. In some embodiments the metal oxide-base may itself be in an aqueous solution before mixing. In other embodiments the metal oxide-base may be a solid and or in powder form.

In some examples, the reductive fuel may be a metal powder. The metal powder may be aluminum metal powder. In some examples, the metal powder may comprise spherical particles. In some examples, the metal powder may comprise a mean particle diameter of 1 micron, 40 nanometers, up to 100 microns, or up to 100 nanometers. In other examples, various sizes of metal powders may be used. In other embodiments metal powders may be microparticles.

In other examples, metal powders of other metals may be used. These metal powders may include iron, nickel, titanium, zirconium, magnesium, zinc, lithium, silicon, boron, tin, tungsten, molybdenum and or a transition metal or any other metal known in the art.

In some examples, reductive fuel (as metal powders or otherwise) may be sourced from Earth. In other examples, sources may include recycling space debris, satellites in orbit, or other materials transported from Earth to space. In other examples, metal powders may be sourced from space. Sources may also include in-situ resources utilization such as materials from the Moon (lunar regolith), Mars (martian regolith), and/or asteroid sources.

In some examples, reductive fuel (as metal powders or otherwise) may be sourced from waste outputs of industrial processes, or products of other combustion processes or waste disposal from human or robotic activity.

The aqueous solution into which the reductive fuel is dispersed may be selected from the group comprising: methanol, ethanol, propanol, butanol, pentanol or combinations thereof, water, or any other liquid or fluid known in the art.

Metal oxides (or oxide precursors) may be selected from: CuO, NiO, $TiO_2$, $WO_3$, $MoO_3$, $Fe_2O_3$, $KMnO_4$, or any other oxide known in the art.

In some examples, metal oxides (or oxide precursors) may be sourced from Earth. Such sources may include recycling space debris, reuse satellites in orbit, or other materials transported from Earth to space. In other examples, metal oxides (or oxide precursors) may be sourced from space. Such sources may include the Moon (lunar regolith), Mars (martian regolith), and or asteroid sources.

In some examples, metal oxides (or oxide precursors) may be sourced from waste outputs of industrial processes, or products of other combustion processes or waste disposal from human or robotic activity.

After the reductive fuel and the metal oxide-base are mixed a reductive fuel/metal oxide-base self-assembled mixture 132*a* occurs, wherein the metal oxide-base ions re-assemble into metal oxide-base molecules on the surface of the reductive fuel 110.

The mixed solution is filtered to collect any solid material (comprising reductive fuel/metal oxide-base 132*a*) and the solid material is heated (arrow 140). Heating results in a reductive fuel/oxide nanostructure 142*a* wherein the base is removed and only metal oxide 144 (black dotted circles, only one labelled to reduce clutter) is present on the reductive fuel 110. The nanostructure is a core-shell nanostructure wherein the reductive fuel is the core and the metal oxide is the shell.

In other examples, methods other than filtration may be utilized to separate product solids from solution. Such methods may include centrifugation, evaporation, or any other method known in the art for separating solids from liquids.

In various embodiments heating may include calcination, annealing, desiccation, inductive heating, radiative heating (e.g. electromagnetic frequencies such as microwaves and or lasers), inductively coupled, and or magnetically coupled methods. In other embodiments, heating may be provided as a secondary source of thermal radiation such as using the solar concentrators and/or an exothermic reaction.

As described above, in the embodiment of FIG. 1A, the base is in excess of the metal oxide. This excessive ratio of base to metal oxide is an integral factor in the final nanostructure of the reductive fuel/metal oxide being a core-shell nanostructure, wherein the surface of the reductive fuel is coated by the metal oxide. In FIG. 1A, it can be seen that the coating is well dispersed.

Figure 1B:
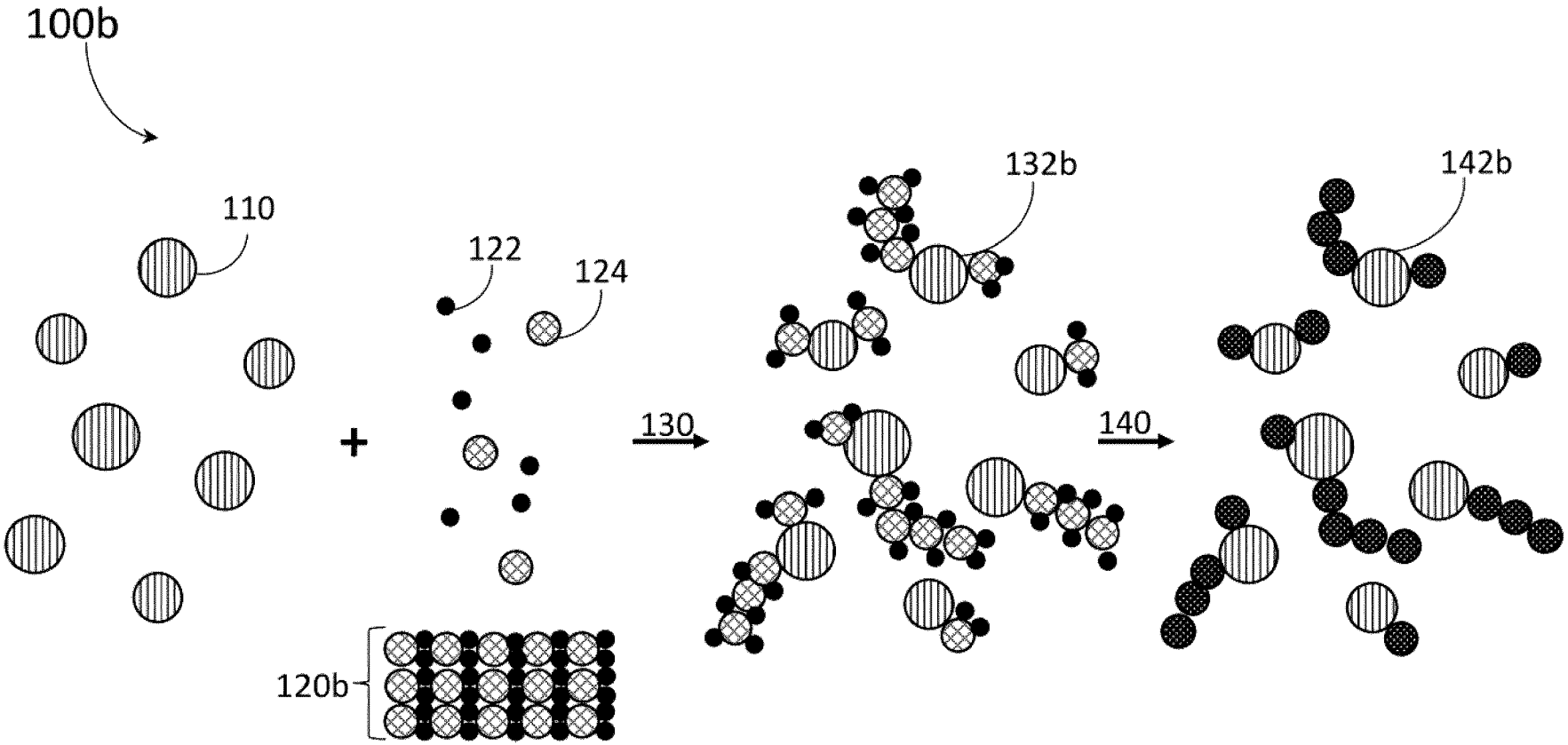
FIG. 1B is a schematic diagram of a method of controllable synthesis of nanoparticle metastable intermolecular composites using a reductive fuel, an metal oxide, and a base, according to a second embodiment.

In FIG. 1B the method is the same as in FIG. 1A but the base is not in excess of the metal oxide.

Referring now to FIG. 1B, shown therein is a schematic diagram of the components of a method 100*b* of controllable synthesis of nanoparticle metastable intermolecular composites using a reductive fuel, an metal oxide, and a base, according to a second embodiment wherein the base is not in excess of the metal oxide, as in FIG. 1A. The steps of method 100*b* are identical to those of method 100*a* with the only difference being the different base/metal oxide ratio.

The method 100*b* includes mixing a reductive fuel 110 (striped circles, only one labelled to reduce clutter) (e.g., aluminum, magnesium, silicon, boron, etc.) with an metal oxide-base complex 120*b* which comprises a metal oxide (e.g., copper, nickel, iron, etc.) and a base (e.g., ammonia, organic amines). The metal oxide and base interact to form an metal oxide-base molecule, for example, if the metal oxide were copper and the base were ammonia, as described further below, the metal oxide-base molecule would be $Cu(OH)_x(NO_3)_y$. The reductive fuel 110 is dispersed within an aqueous solution and the metal oxide-base is mixed (arrow 130) into the reductive fuel aqueous solution. Within the solution the metal oxide-base complex exists as ions 122 (black circles, only one labelled to reduce clutter) and ions 124 (hatched circles, only one labelled to reduce clutter) which interact with the reductive fuel 110. For example, in the copper/ammonia example, the ions would be $Cu(NH_3)_4^{2+}$ and $NO_3$. In some embodiments the metal oxide-base may itself be in an aqueous solution before mixing. In other embodiments the metal oxide-base may be a solid and or in powder form.

After the reductive fuel and the metal oxide-base are mixed a reductive fuel/metal oxide-base self-assembled mixture 132*b* occurs, wherein the metal oxide-base ions re-assemble into metal oxide-base molecules on the surface of the reductive fuel 110.

The mixed solution is filtered to collect any solid material (comprising reductive fuel/metal oxide-base 132*b*) and the solid material is heated (arrow 140). Heating results in a reductive fuel/oxide nanostructure 142*b* wherein the base is removed and only metal oxide 144 (black dotted circles, only one labelled to reduce clutter) is present on the reductive fuel 110. The nanostructure 142*b* is a well-mixed nanocomposite wherein the reductive fuel is not well coated by the metal oxide and wherein there may be multiple metal oxide molecules in a complex together on the surface of the reductive fuel.

In various embodiments heating may include calcination, annealing, desiccation, or inductive heating, radiative heating (e.g. electromagnetic frequencies such as microwaves and or lasers), inductively coupled, and or magnetically coupled methods. In other embodiments, heating may be provided as a secondary source of thermal radiation such as using the solar concentrators and/or an exothermic reaction.

Method 100 does not require any specialized equipment and, therefore, could be used for mass production of energetic nanoparticles/nanocomposites.

As described above, in the embodiment of FIG. 1B, the base is not in excess of the metal oxide. The ratio of base to metal oxide is an integral factor in the final nanostructure of the reductive fuel/metal oxide being a well-mixed nanocomposite, wherein the surface of the reductive fuel is not coated by the metal oxide but rather single or complexed molecules of the metal oxide are unevenly dispersed on the surface of the reductive fuel. In FIG. 1B, it can be seen that reductive fuel is not well-coated and the metal oxide molecules have complexed.

The different nanostructures of the synthesized MICs have different energetic performance characteristics which will be discussed below. Therefore, the controllable method as described above and further described below allows for tuning of the characteristics of the final product of the synthesis by altering the $NH_3$/Cu ratio as well as the Al/CuO equivalence ratio. This tuning is achieved due to the altered structure of the final Al/CuO nanocomposite/nanoparticle product.

Figure 2:
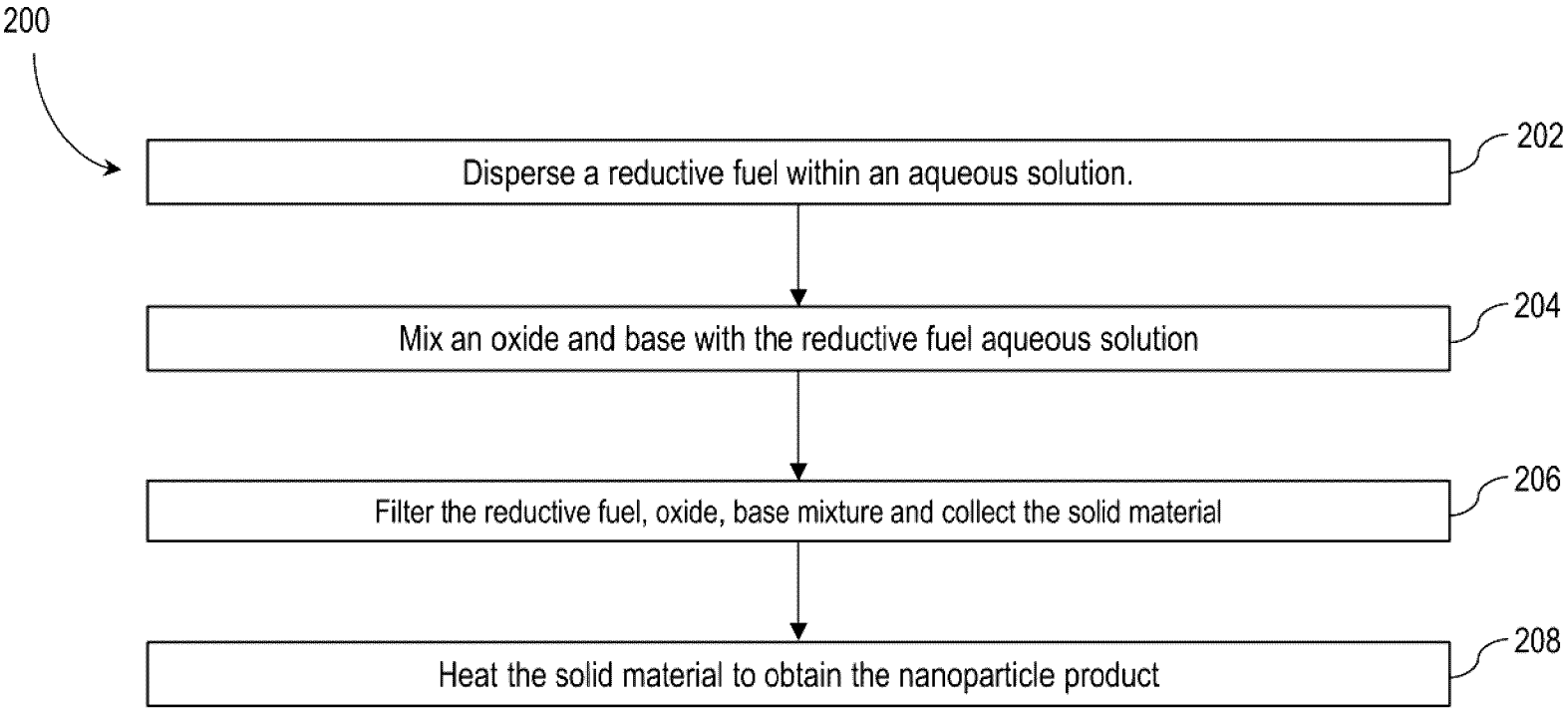
FIG. 2 is a flow diagram of a basic method of synthesis of nanoparticle metastable intermolecular composites using a wet-chemistry system, according to an embodiment.

FIG. 2 is a flow diagram of a basic method 200 of synthesis of nanoparticle metastable intermolecular composites using a wet-chemistry system, according to an embodiment.

At 202, the reductive fuel is dispersed within an aqueous solution by a disperser. The disperser may be a sonicator or any other mechanism or means which enable the dispersion of the reductive fuel within the aqueous solution.

At 204, a metal oxide and base are mixed with the reductive fuel aqueous solution.

At 206, the mixture of reductive fuel, metal oxide, and base is filtered and any solid material is collected.

At 208, the solid material is heated to obtain a nanocomposite/nanoparticle MIC product.

Figure 3:
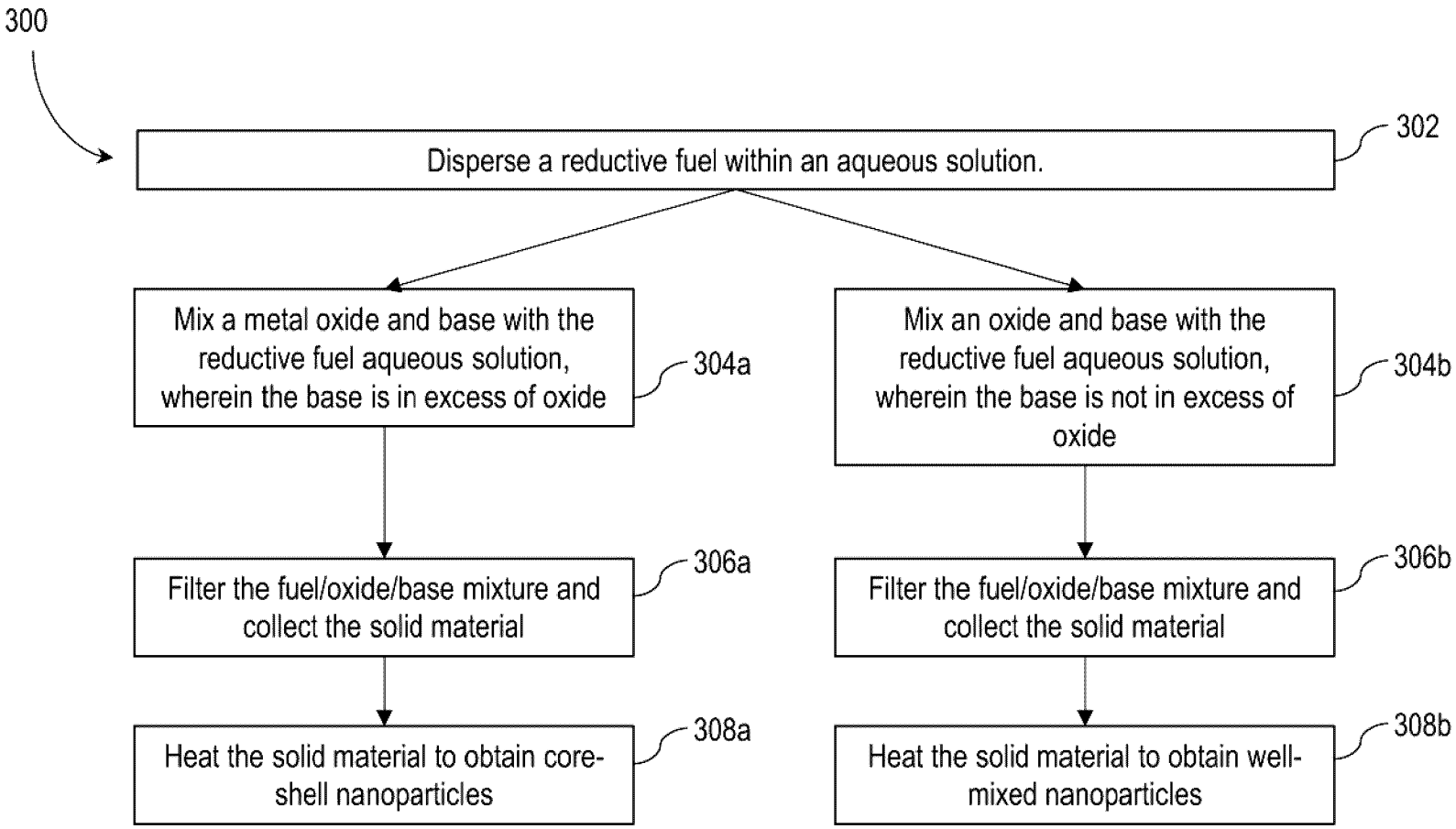
FIG. 3 is a flow diagram of a method of controllable synthesis of nanoparticle metastable intermolecular composite, according to the embodiments of FIGS. 1A and 1B.

Method 200 represents the standard steps to achieve the final nanocomposite/nanoparticle product of the synthesis. FIG. 3, discussed below, represents the controllable method wherein the ratio of metal oxide to base can be altered to tune the structure and energetic performance characteristics of the final product of the synthesis.

FIG. 3 is a flow diagram of a controllable method 300 of synthesis of nanoparticle metastable intermolecular composites, according to the embodiments of FIGS. 1A and 1B. The method is the same as method 200 but describes the different final products which are achieved by altering the ratio of metal oxide and base.

At 302, the method 300 is the same as method 200, and the reductive fuel is dispersed within an aqueous solution.

At 304, the method 300 is the same as 300, and a metal oxide and base are mixed with the reductive fuel aqueous solution. However in method 300, step 304 and the method beyond are split into two prongs. The first prong occurs when the base is in excess of the metal oxide 304*a*. The second prong occurs when the base is not in excess of the metal oxide 304*b*.

At 306*a* which follows from 304*a* and 306*b* which follows from 304*b*, the mixture from 304*a/b* is filtered and any solid material is collected.

At 308*a*, the solid material which was created with the base in excess of the metal oxide is heated and a core-shell nanoparticle structured MIC is obtained.

At 308*b*, the solid material which was created with the base not in excess of the metal oxide is heated and a well-mixed nanocomposite structured MIC is obtained.

Method 300 does not require any specialized equipment and, therefore, can be used for mass production of energetic particles which are tuned to have specific energetic performance characteristics. Therefore, method 300 allows a user to create large amounts of energetic particles which are targeted to a specific use-case, for example a reaction which only occurs at a specific temperature.

FIGS. 1-3 described a standard non-specific method for wet-chemistry synthesis of MICs wherein the specific structure of the MICs can be tuned to core-shell nanoparticles or well-mixed nanocomposites by altering ratios of the initial components of the synthesis. FIGS. 4-11 describe a specific embodiment for synthesizing Al/CuO core-shell nanoparticle/well-mixed nanocomposite MICs. The further specifics of the method which are shown and described in FIGS. 4-11 are applied herein to an aluminum (reductive fuel), copper oxide (metal oxide), and ammonia (base) system but could be generally applied to any configuration of aluminum, metal oxide, and base which is suited to the synthesis of nanocomposite/nanoparticle metastable intermolecular composites.

Figure 4A:
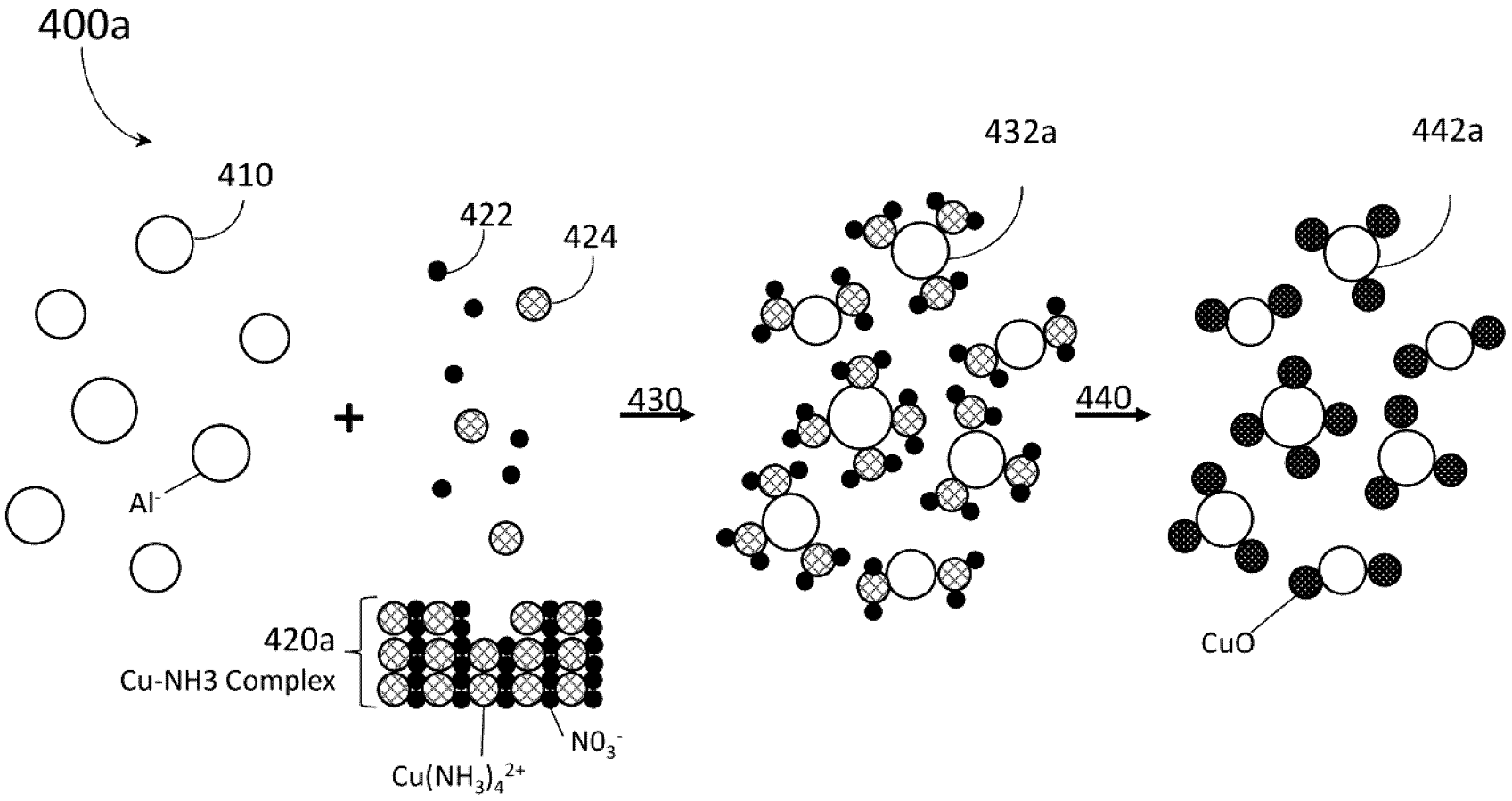
FIG. 4A is a schematic diagram of a method of controllable synthesis of nanoparticle metastable intermolecular composites using aluminum, copper, and ammonium, according to a first set of parameters.

FIG. 4A is a schematic diagram of a method 400*a* of controllable synthesis of nanoparticle metastable intermolecular composites using aluminum, copper, and ammonium, according to a first set of parameters.

Figure 4B:
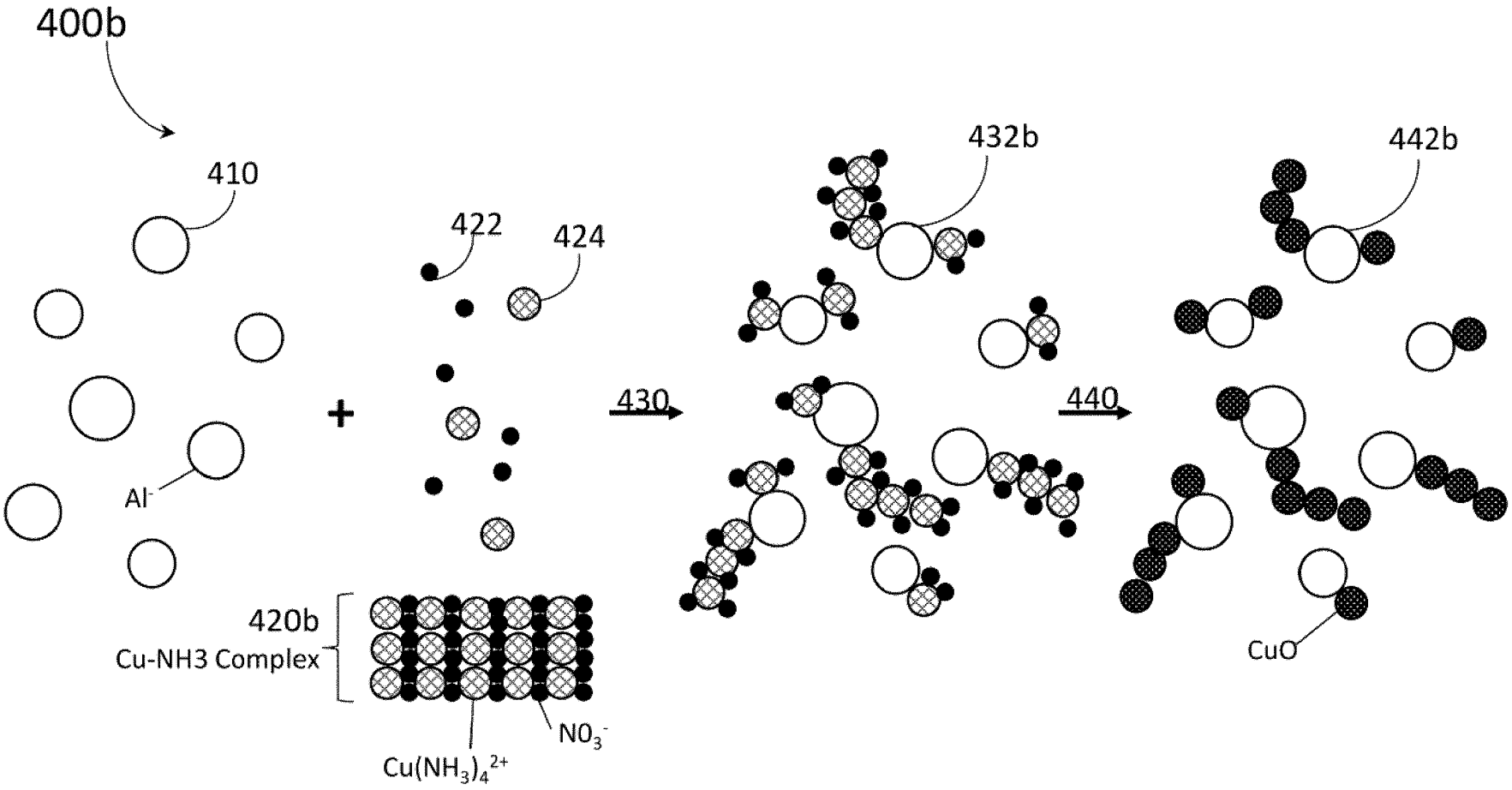
FIG. 4B is a schematic diagram of a method of controllable synthesis of nanoparticle metastable intermolecular composites using aluminum, copper, and ammonium, according to a second set of parameters.

FIG. 4B is a schematic diagram of a method 400*b* of controllable synthesis of nanoparticle metastable intermolecular composites using aluminum, copper, and ammonium, according to a second set of parameters.

The method 400*a* includes mixing aluminum nanoparticles 410 (empty circles, only one labelled to reduce clutter) with a copper ammonia complex 420*a*. In the embodiment of FIG. 4A the ammonia (base) is in excess of the copper oxide (metal oxide).

The aluminum nanoparticles 410 are in the form of an aqueous solution created by dispersing aluminum nanoparticles in ethanol by sonication in a sonication bath. The copper ammonia complex 420*a* is created by mixing ammonia solution into Cu(NO3)2·2.5H2O solution in ethanol. The ammonia is in excess of the copper oxide in the copper ammonia complex solution.

The aluminum solution and the copper ammonia solution are mixed (arrow 430). Within the solution the copper ammonia complex exists as $Cu(NH_3)_4^{2+}$ ions 422 (black circles, only one labelled to reduce clutter) and $NO_3^-$ ions 424 (hatched circles, only one labelled to reduce clutter) which interact with the aluminum 410.

After the aluminum and the copper ammonia are mixed an Al/Cu—$NH_3$ self-assembled mixture 432*a* occurs, wherein the re-assemble $Cu(NH_3)_4^{2+}$ ions and $NO_3^-$ ions re-assemble into Cu—$NH_3$ on the surface of the aluminum nanoparticles 410.

The mixed solution is filtered to collect any solid material (comprising Al/Cu—$NH_3$ 432*a*) and the solid material is calcinated (arrow 440). Calcination results in a Al/CuO nanostructure 442*a* wherein elements of the ammonia are removed and only copper oxide 444 (black dotted circles, only one labelled to reduce clutter) is present on the reductive fuel 410. The nanostructure is an Al/CuO core-shell nanostructure wherein the aluminum nanoparticles 410 are the core and the copper oxide (CuO) is the shell.

As described above, in the embodiment of FIG. 4A, the ammonia is in excess of the copper oxide. This excessive ratio of ammonia to copper oxide is an integral factor in the final nanostructure of the Al/CuO being a core-shell nanostructure, wherein the surface of the aluminum nanoparticles is coated by the copper oxide. In FIG. 4A, it can be seen that the coating is well-coated and the CuO is evenly dispersed on the surface of the aluminum nanoparticles.

In FIG. 4B the method is the same as in FIG. 4A but the ammonia is not in excess of the copper oxide.

Referring now to FIG. 4B, shown therein is a schematic diagram of the components of a method 400*b* of controllable synthesis of nanoparticle metastable intermolecular composites using a aluminum, copper oxide, and ammonia, according to a second embodiment wherein ammonia is not in excess of the copper oxide, as in FIG. 1A. The steps of method 400*b* are identical to those of method 400*a* with the only difference being the different ammonia/copper oxide ratio.

The method 400*a* includes mixing aluminum nanoparticles 410 (empty circles, only one labelled to reduce clutter) with a copper ammonia complex 420*a*. In the embodiment of FIG. 4A the ammonia (base) is not in excess of the copper oxide (metal oxide).

The aluminum nanoparticles 410 are in the form of an aqueous solution created by dispersing aluminum nanoparticles in ethanol by sonication in a sonication bath. The copper ammonia complex 420*a* is created by mixing ammonia solution into Cu(NO3)2·2.5H2O solution in ethanol. The ammonia is not in excess of the copper oxide in the copper ammonia complex solution.

The aluminum solution and the copper ammonia solution are mixed (arrow 430). Within the solution the copper ammonia complex exists as $Cu(NH_3)_4^{2+}$ ions 422 (black circles, only one labelled to reduce clutter) and $NO_3^-$ ions 424 (hatched circles, only one labelled to reduce clutter) which interact with the aluminum 410.

After the aluminum and the copper ammonia are mixed an Al/Cu—$NH_3$ self-assembled mixture 432*a* occurs, wherein the re-assemble $Cu(NH_3)_4^{2+}$ ions and $NO_3^-$ ions re-assemble into Cu—$NH_3$ on the surface of the aluminum nanoparticles 410.

The mixed solution is filtered to collect any solid material (comprising Al/Cu—$NH_3$ 432*a*) and the solid material is calcinated (arrow 440). Calcination results in a Al/CuO nanostructure 442*a* wherein the elements of the ammonia are removed and only copper oxide 444 (black dotted circles, only one labelled to reduce clutter) is present on the aluminum nanoparticles 410. The nanostructure is an Al/CuO well-mixed nanocomposite wherein the aluminum nanoparticles 410 are not well-coated by the CuO and the CuO may be complexed together to form groups or chains of CuO molecules on the surface of the aluminum nanoparticles.

As described above, in the embodiment of FIG. 4A, the ammonia is not in excess of the copper oxide. The ratio of ammonia to copper oxide is an integral factor in the final nanostructure of the Al/CuO being a well-mixed nanocomposite (and not a core-shell structure), wherein the surface of the aluminum nanoparticles is not coated by the copper oxide. In FIG. 4A, it can be seen that aluminum is not well-coated and the CuO have complexed.

In other embodiments of the basic method as described in FIGS. 1-4 other reductive fuels, metal oxides, and bases may be used. The specific ratios of base to metal oxide which enable the final product to have various structural compositions may be different depending on the specific reductive fuels, metal oxides, and bases employed. That is, in some embodiment the base may always be in excess of the metal oxide, stoichiometrically, but the extent of the excessiveness may determine whether a core-shell structure or well-mixed structure is achieved for the final product. As well, vice versa, in some embodiments, the metal oxide may always be in excess of the base, stoichiometrically.

The different nanostructures of the synthesized MICs have different energetic performance characteristics which will be discussed below.

Figure 5:
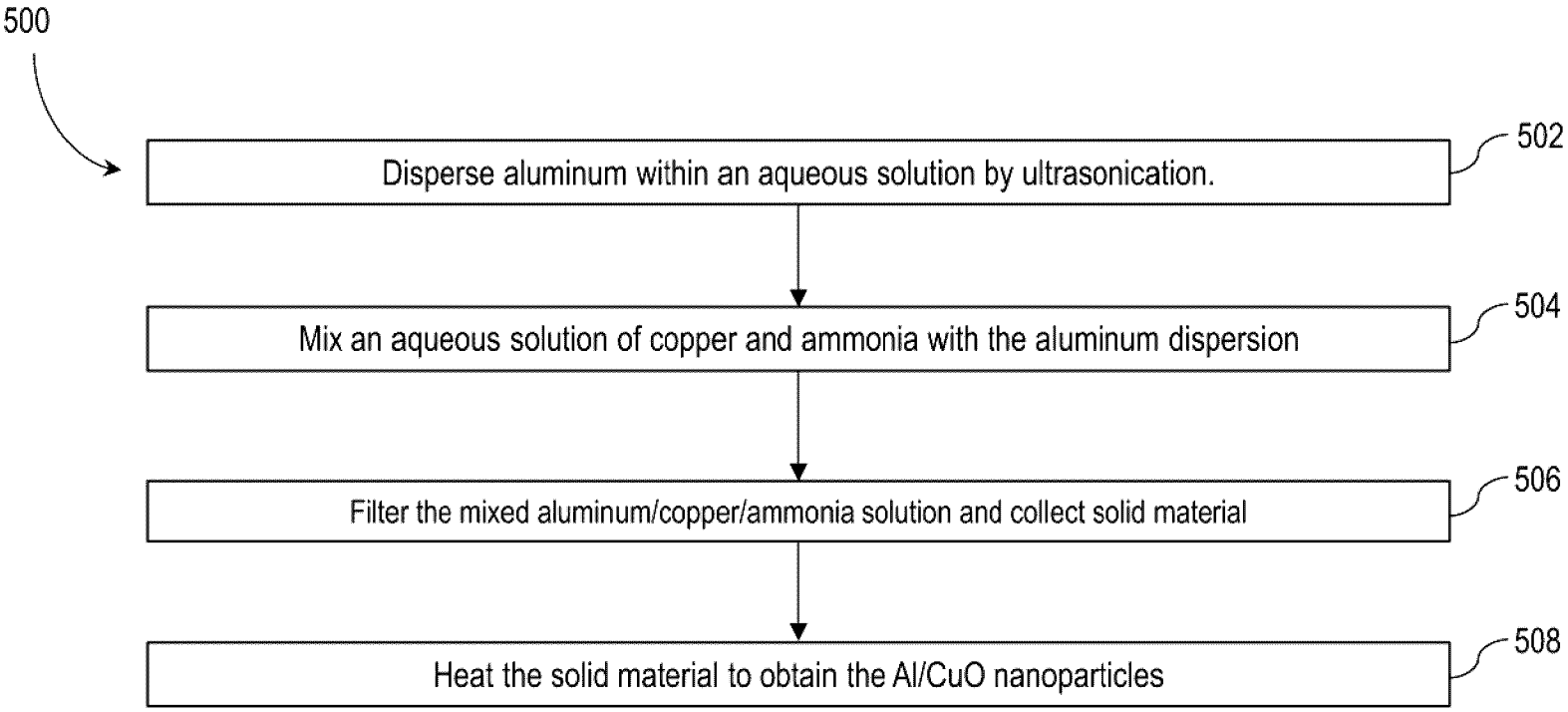
FIG. 5 is a flow diagram of a method of controllable synthesis of nanoparticle metastable intermolecular composites using aluminum, copper, and ammonium, according to an embodiment.

FIG. 5 is a flow diagram of a basic method of synthesis of nanoparticle metastable intermolecular composites using aluminum, copper, and ammonium, according to an embodiment.

At 502, aluminum nanoparticles are dispersed within an aqueous solution by sonication. In other embodiments, any other sufficient mechanism for dispersion of the aluminum nanoparticles within an aqueous solution could be employed.

At 504, copper oxide and ammonia are mixed with the aluminum solution in the form of a copper ammonia complex aqueous solution. The aluminum and the copper ammonia may be mixed by stirring, for example, a magnetic stir bar and stir plate could be used. In other embodiments, the aluminum and copper ammonia may be mixed together by any means of mixing, for example, an agitator could be used.

In other embodiments, magnetohydrodynamics may be used to mix the materials together using magnets and or electromagnets.

At 506, the mixture of aluminum and copper ammonia is filtered and any solid material is collected. The mixing of aluminum and copper ammonia creates a precipitant which includes aluminum nanoparticles, copper ammonia, and aluminum copper ammonia (Al/Cu—$NH_3$).

At 508, the solid material is calcinated to obtain aluminum copper oxide (Al/CuO) nanoparticles having a core-shell structure as described above and shown in FIG. 4A. Calcination may include heating the solid to a high temperature for a period of time, for example 230° C. for 3 hours.

Figure 6:
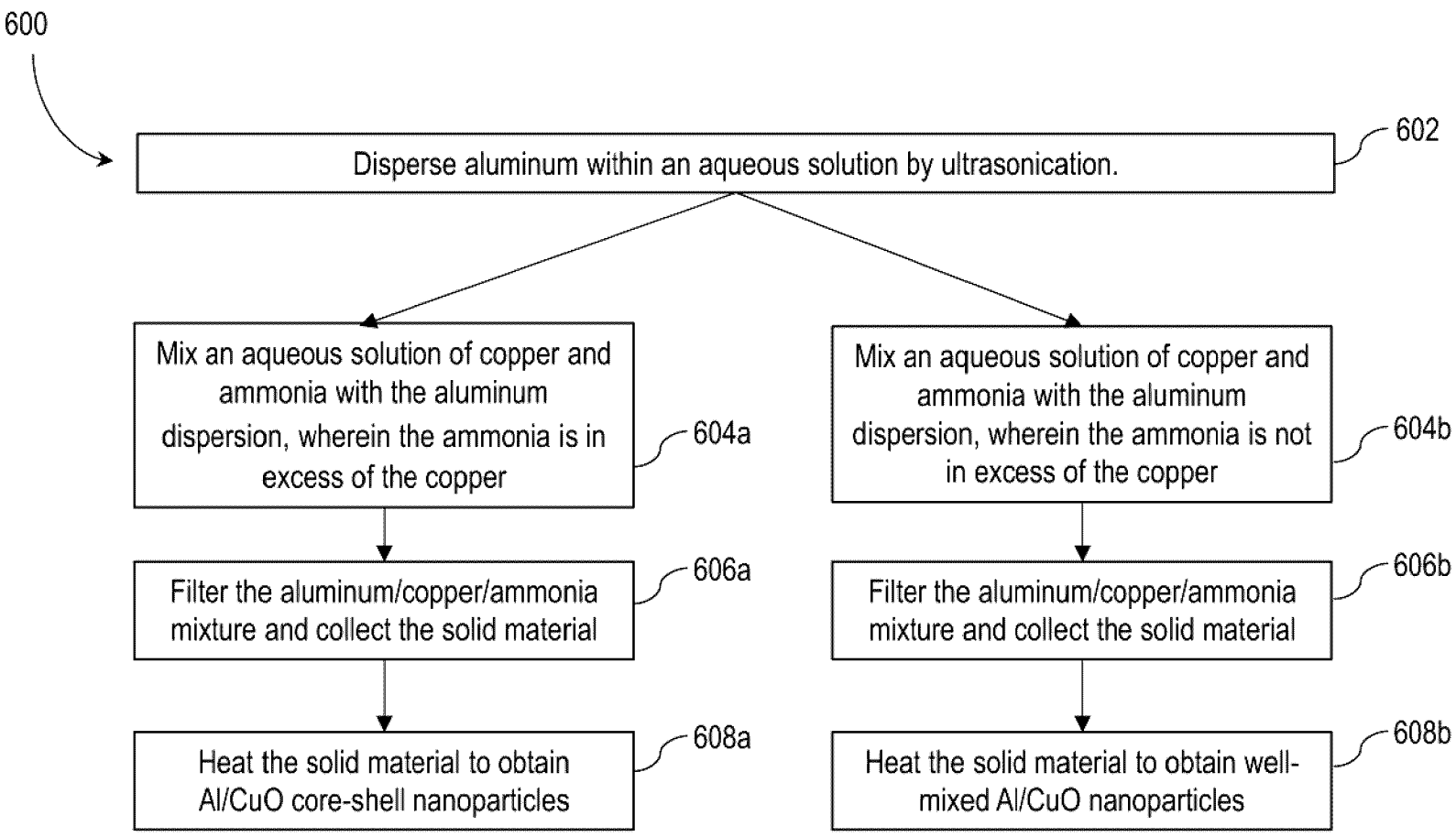
FIG. 6 is a flow diagram of a controllable method of synthesis of nanoparticle metastable intermolecular composites using aluminum, copper, and ammonium, according to the embodiments of FIGS. 4A and 4B

FIG. 6 is a flow diagram of a controllable method of synthesis of nanoparticle metastable intermolecular composites using aluminum, copper, and ammonium, according to the embodiments of FIGS. 4A and 4B.

At 602, the method 600 is the same as method 500. At 602, aluminum nanoparticles are dispersed within an aqueous solution by sonication. In other embodiments, any other sufficient mechanism for dispersion of the aluminum nanoparticles within an aqueous solution could be employed.

At 604, the method 600 is the same as 504 of method 500. At 604*a/b*, copper oxide and ammonia are mixed with the aluminum solution in the form of a copper ammonia complex aqueous solution. The aluminum and the copper ammonia may be mixed by stirring. In other embodiments, the aluminum and copper ammonia may be mixed together by any means of mixing. In other embodiments, magnetohydrodynamics may be used to mix the materials together using magnets and or electromagnets.

However in method 600, step 604 (and the method beyond) are split into two prongs. The first prong, 604*a*, occurs when the base is in excess of the metal oxide. The second prong, 604*b*, occurs when the base is not in excess of the metal oxide.

At 606*a* which follows from 604*a* and 606*b* which follows from 604*b*, the mixture from 604*a* and *b*, respectively, is filtered and any solid material is collected. The mixing of aluminum and copper ammonia creates a precipitant which includes aluminum nanoparticles, copper ammonia, and aluminum copper ammonia (Al/Cu—$NH_3$).

At 608*a*, the solid material which was created with the ammonia in excess of the copper oxide is calcinated and a core-shell nanoparticle structured Al/CuO MIC is obtained.

At 608*b*, the solid material which was created with the ammonia not in excess of the copper oxide is calcinated and a well-mixed nanocomposite structured Al/CuO MIC is obtained.

Method 600 does not require any specialized equipment and, therefore, can be used for mass production of Al/CuO energetic particles which are tuned to have specific energetic performance characteristics. That is, method 600 allows a user to create large amounts of Al/CuO energetic particles which are targeted to a specific use-case, for example, a reaction which only occurs at a specific temperature.

Further specifics of the formation mechanism and controllable synthesis of Al/CuO energetic nanocomposites are discussed below, including the energetic performance properties of the various structures created in relation to specific ratios of ammonia to copper during synthesis and specific equivalence ratios of aluminum to copper of the Al/CuO nanoparticles/nanocomposite.

The following FIGS. 7-11 show and describe the results of various experiments performed on the products of the methods described above in FIGS. 3-6.

In an embodiment, 50 mg Al nanoparticle was dispersed in 15 mL ethanol in a sonication bath for 2 hours, while a copper ammonia complex suspension was prepared by adding the calculated amount of ammonia solution into $Cu(NO_3)_2 \cdot 2.5H_2O$ solution in 10 mL ethanol. After the 2-hour sonication, the copper ammonia complex (Cu—$NH_3$ complex) suspension and an extra 25 mL ethanol were added to the Al dispersion. The mixture was stirred for 1 hour before being filtered. The solid (Al/Cu—$NH_3$ mixture) was collected and annealed at 230° C. for 3 hours to obtain the final Al/CuO core-shell product.

When ammonia was in excess the Al/Cu—$NH_3$ mixture precipitated quickly to the bottom of the container with an almost clear supernatant. There was no significant concentration gradient caused by a slow precipitating process or low-density flocculent material, indicating the formation of a denser solid in the mixture between all the Al nanoparticles and Cu—$NH_3$ complex resulted from a self-assembly process.

When ammonia was not in excess the precipitating process of the Al/Cu—$NH_3$ complex mixture was much slower, and the supernatant was not clear until a few days. Therefore, the amount of ammonia relative to copper significantly changed the self-assembly process and the structure as well as the energetic properties of the final composite (as will be discussed below).

Two variables, equivalence ratio (ER) and ammonia to copper ratio (NH3/Cu ratio) were investigated to find out how they affect the formation and energetic performance of the final Al/CuO product. The nominal equivalence ratio of the Al/CuO final product was calculated using the mole amount of active aluminum core and copper nitrate as shown in the following equation:

$$\frac{(n_{Al}/n_{CuO})_{actual}}{(n_{Al}/n_{CuO})_{stoichiometry}} = \frac{(n_{Al}/n_{Cu(NO_3)_2})_{actual}}{(n_{Al}/n_{CuO})_{stoichiometry}}$$

Ammonia to copper ratio was calculated by the molar amount of ammonia and copper nitrate used to obtain the Cu—$NH_3$ complex suspension. The concentration of ammonia used in the calculation was 30%. Samples with equivalence ratios of 1.5, 2.0, 2.5, 3.0, and 4.0, and ammonia to copper ratios of 4, 6, 8, and 16 were analyzed. $NH_3$/Cu ratio at 4 is the stoichiometric value of forming the complex coordination ion of $Cu(NH_3)_4^{2+}$. Therefore, for the samples with $NH_3$/Cu at 4, copper was in excess. A few examples of the amounts of raw materials are listed in Table 1.

TABLE 1

Amounts of raw materials of the samples.

| ϕ | $NH_3$/Cu ratio | Al nanoparticles | $Cu(NO_3)_2 \bullet 2.5H_2O$ | 30% ammonia |
|---|---|---|---|---|
| 1.5 | 6 | 50 mg | 360 mg | 540 μL |
| 2.0 | 6 | 50 mg | 269 mg | 405 μL |
| 2.5 | 6 | 50 mg | 215 mg | 328 μL |
| 2.5 | 8 | 50 mg | 215 mg | 430 μL |
| 3.0 | 6 | 50 mg | 180 mg | 270 μL |
| 4.0 | 6 | 50 mg | 135 mg | 203 μL |

Two Cu—NH3 complex samples at NH3/Cu ratios of 4 and 16 were prepared by adding the calculated amount of ammonia aqueous solution to Cu(NO3)2·2.5H2O/ethanol solution. The precipitation was filtered and dried at 70° C. overnight to obtain the target product.

Five reference Al/CuO samples of the corresponding equivalence ratios were prepared using ultrasonication as a set of standard samples to compare with the core-shell samples.

Figure 7:
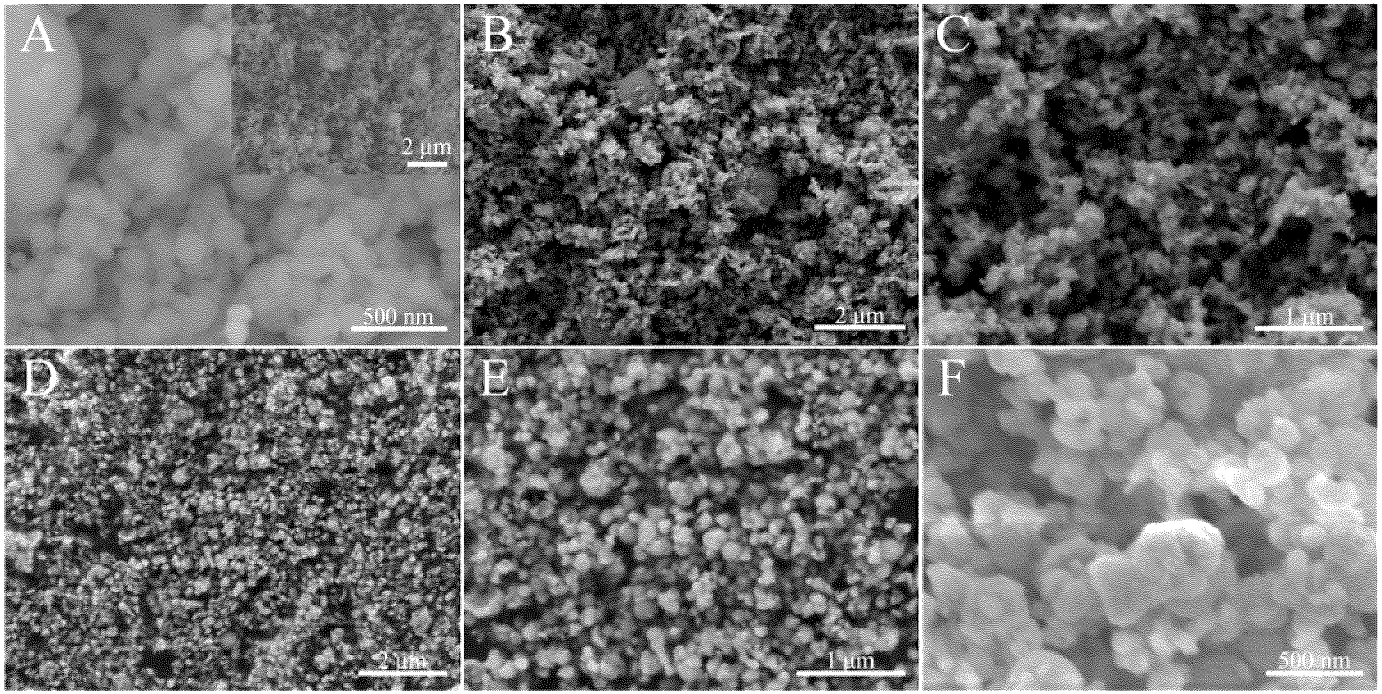
FIG. 7 is a series of scanning electron microscopy (SEM) images of Al/CuO coreshell MICs synthesized from various $NH_3$/Cu ratios.

FIG. 7 is a series of scanning electron microscopy (SEM) images of Al/CuO coreshell MICs synthesized from various $NH_3$/Cu ratios. FIG. 7A shows Al nanoparticles. FIGS. 7B and 7C show Al/CuO nanoparticles/nanocomposite at ER=2.5 and $NH_3$/Cu=4. FIGS. 7D, 7E, and 7F show Al/CuO nanoparticles/nanocomposite at ER=2.5 and $NH_3$/Cu=16.

Figure 8:
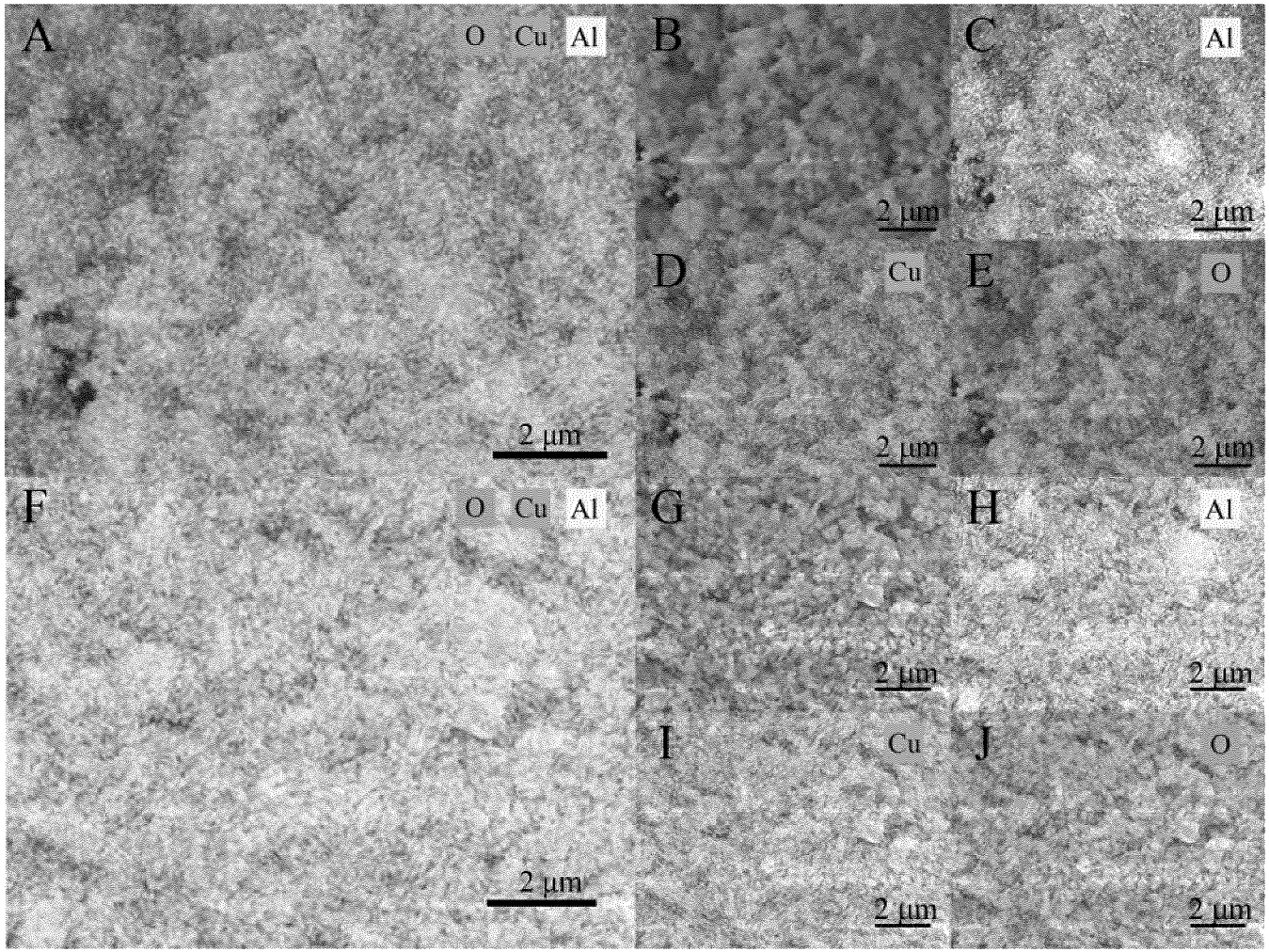
FIG. 8 is a series of EDS mappings of Al/CuO core-shell nanoparticles at various ERs and $Nh_3$/Cu ratios.

FIG. 8 is a series of EDS mappings of Al/CuO nanocomposites/nanoparticles at various ERs and $Nh_3$/Cu ratios. FIGS. 8A-E show Al/CuO nanocomposites/nanoparticles at ER=2.5 and $NH_3$/Cu=4. FIGS. 8F-J show Al/CuO nanocomposites/nanoparticles at ER=2.5 and $NH_3$/Cu=16.

Aluminum nanoparticles, as shown in 7A, are mostly sized around 100 nm diameter (60-200 nm), with some impurities such as large particles around 1 micron. The uncoated aluminum nanoparticles are nearly perfectly spherical and demonstrated a very smooth surface. The Al/CuO core-shell nanoparticle, on the other hand, exhibits a completely different morphology, as shown in FIGS. 7B-F.

FIGS. 7B and C show the Al/CuO energetic nanocomposite synthesized when Cu is slightly excessive ($NH_3$/Cu calculated ratio at 4). Many small nanoparticles exist in the sample, indicating the formation of CuO in the sample. The formed CuO nanoparticles are smaller than the Al nanoparticles shown in 7A, roughly between 20-60 nm. The CuO nanoparticles form some irregular clusters, possibly due to some aggregation among the nanoparticles themselves. The coating of CuO on Al nanoparticles is not well developed. Only a small fraction of Al nanoparticles are well-coated while a large fraction of Al nanoparticles are left only partly coated or even un-coated, as shown in FIG. 7C. The EDS result in FIGS. 8A-E confirms an even distribution of Al and CuO throughout the sample. Therefore, instead of an Al/CuO "core-shell" nanoparticle, the sample is better described as a well-mixed Al/CuO nanocomposite synthesized via the wet-chemistry method when copper was slightly excessive compared to ammonia in the complex.

FIGS. 7D-F show the SEM images of the Al/CuO core-shell nanoparticle when ammonia is excessive (NH3/Cu calculated ratio at 16). Different from FIG. 7B, there is no sign of CuO clusters formed as shown in FIG. 7D, the Al and CuO nanoparticles are distributed more evenly in the sample, as confirmed by the EDS mapping in FIG. 8F-J. Compared to FIG. 7C, the formation of "core-shell" Al/CuO is much better in FIG. 7E. There are still some Al left uncoated, while there was a large part of Al particles that were either well-coated or partly coated. A close-up of some of the well-coated Al/CuO core-shell nanoparticles is shown in FIG. 7F. FIGS. 7E and F show that the CuO nanoparticles are smaller than the Al nanoparticles, allowing them to assemble onto the surface of Al and form a shell. Therefore, an excessive amount of NH3 facilitates the formation of core-shell structured Al/Cu—NH3 complex, leading to better Al/CuO core-shell nanostructures after calcination.

FIGS. 9A-c are a series of X-ray diffraction (XRD) spectra of various copper compounds.

It was hypothesized that the different Al/CuO structures in the final energetic nanocomposites, produced from different $NH_3$ to Cu ratios, result from the different Cu—$NH_3$ complex structures deposited onto the surface of Al nanoparticles. XRD of two Cu—$NH_3$ complex samples was taken to compare the crystalline structures of the Cu—$NH_3$ complex precipitations formed from different $NH_3$/Cu ratios at 4 and 16, as shown in FIG. 9. The two curves in FIG. 9A exhibit peaks at about the same 2θ value, but with drastically different intensities, indicating more than one composite is present in the Cu—$NH_3$ complex. Two kinds of copper composites correspond well to both XRD data and experiment procedure: $Cu(NH_3)_4(NO_3)_2$ (shilovite), and $Cu(OH)_3(NO_3)$ (rouaite). By comparing the characteristic peaks at 2θ=12.8° (rouaite), 15.2°, 21.3°, and 31.0° (shilovite), the ammonia-rich sample ($NH_3$/Cu ratio=16) was found to contain more shilovite ($Cu(NH_3)_4NO_3$) and the ammonia poor sample ($NH_3$/Cu ratio=4) to contain more rouaite ($Cu(OH)_3(NO_3)$). When ammonia is in excess, $Cu(NH_3)_4^{2+}$ is favored to form. When the ammonia concentration is low, the competing reaction between $Cu^{2+}$ and $OH^-$ in a less acidic or alkalic environment becomes more important.

When the copper ammonia complex suspension was added to the Al/ethanol dispersion, two different types of suspended substances, Al particles and Cu—$NH_3$ complex, co-existed in the mixture and both precipitate. However, instead of precipitating separately, these two precipitants assembled into a core-shell structure of Al/Cu—$NH_3$ complex, which may be driven by the solubility equilibrium of the Cu—$NH_3$ complex in ethanol, as well as the electrostatic force between Al particles and Cu—$NH_3$ complex. In a typical solubility equilibrium of ionic compounds, the dissolution process of the solid precipitations and the precipitation of the dissolved ions occur at the same time and reach a dynamic equilibrium state when the dissolution and precipitation rates are equal, which occurred for the Cu—$NH_3$ complex in ethanol. However, the precipitation process was different when Al particles co-existed with Cu—$NH_3$ complex precipitation in ethanol.

Al/alcohol dispersion has a positive surface charge due to the oxidized shell of Al particles. When the solution is alkalic due to the addition of ammonia aqueous solution, it turns neutral or even negative especially when pH>9. Al nanoparticles were dispersed in ethanol under sonication and presented a positive surface charge before the Cu—$NH_3$ complex was added. When the addition occurred, the components that co-existed in the mixture are as shown below in Table 2. When the mixture was ammonia poor, for example $NH_3$/Cu ratio=4, the mixture was less alkalic with an insufficient amount of $NH_3$ available to fully react with $Cu^{2+}$. Therefore, the Al exhibited a near-neutral surface charge, while the $Cu^{2+}$ formed more Cu(OH)n instead of $Cu(NH_3)_4^{2+}$. Therefore, there was no significant electrostatic force between Al and Cu—$NH_3$ complex. The Al and Cu—$NH_3$ complex mixture was then filtered and calcinated, forming a well-mixed Al—CuO nanocomposite. However, when the mixture was ammonia-rich, for instance, when $NH_3$/Cu ratio=16, the mixture was more alkalic. As a consequence, Al nanoparticles expressed more negative surface charge and $Cu^{2+}$ reacted more with ammonia and mainly formed $Cu(NH_3)_4^{2+}$ in the precipitation. Therefore, the electrostatic force between negative Al nanoparticles and dissolved positive $Cu(NH_3)_4^{2+}$ triggers the self-assembly between the components, and formation of a core-shell Al/Cu—$NH_3$ complex structure, which is then calcinated to obtain the final core-shell Al/CuO nanostructure. When $NH_3$/Cu was 6 or 8 in other samples, the structure of the final product was between these two extreme conditions, with that being said, $NH_3$ was still excessive compared to $Cu^{2+}$ and the Al/Cu—$NH_3$ mixtures were able to precipitate within a few hours. Therefore, the products were considered closer to core-shell Al/CuO in these samples.

TABLE 2

Characteristics of Al/Cu—$NH_3$ complex mixture.

| Mixture | Component | Characteristics |
|---|---|---|
| Ammonia poor | Al | Near neutral surface charge |
| | Cu | $Cu(OH)_n$ (major) |
| | | $Cu(NH_3)_4^{2+}$ (minor) |
| Ammonia rich | Al | Strongly negative surface charge |
| | Cu | $Cu(NH_3)_4^{2+}$ (major) |
| | | $Cu(OH)_n$ (minor) |

Figure 10B:
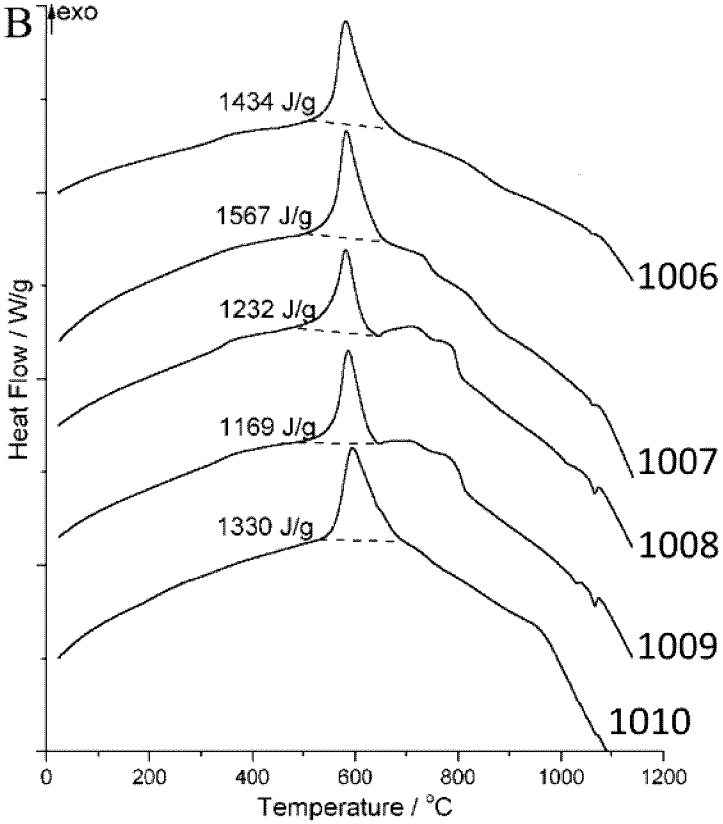
FIG. 10B is a graph of different scanning calorimetry (DSC) results of Al/CuO core-shell nanoparticles/well-mixed nanocomposites created at various $NH_3$/Cu ratios (4, 6, 8, and 16), according to an embodiment.
Figure 10A:
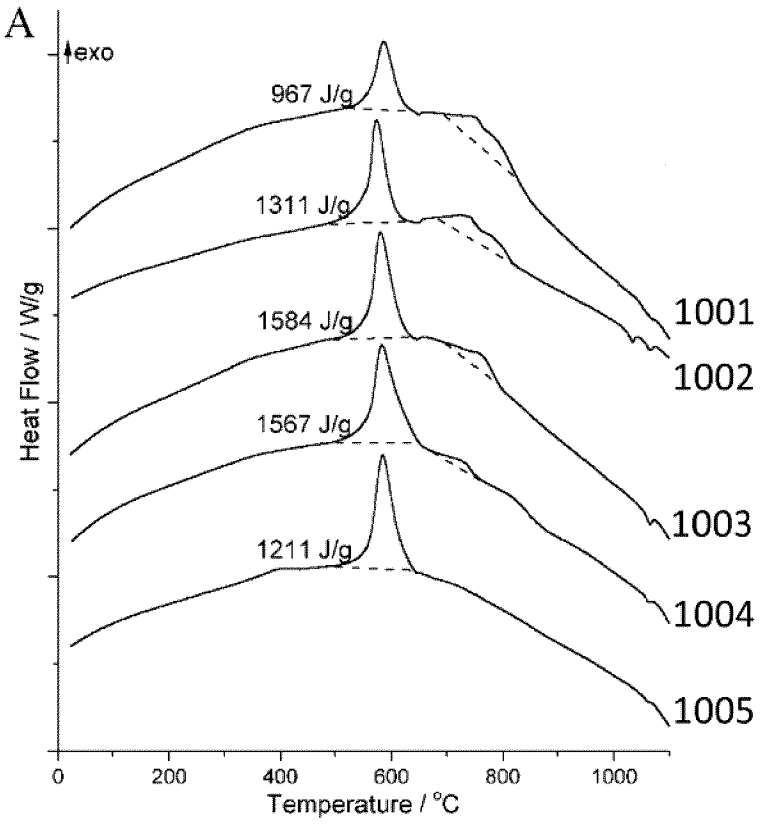
FIG. 10A is a graph of differential scanning calorimetry (DSC) results of Al/CuO core-shell nanoparticles/well-mixed nanocomposites created at various equivalence ratios (ER) (1.5, 2.0, 2.5, 3.0, and 4.0), according to an embodiment.

FIG. 10A is a graph of differential scanning calorimetry (DSC) results of Al/CuO nanoparticles/nanocomposites created at various equivalence ratios (ER) (1.5, 2.0, 2.5, 3.0, and 4.0), according to an embodiment. FIG. 10B is a graph of different scanning calorimetry (DSC) results of Al/CuO nanocomposites/nanoparticles created at various $NH_3$/Cu ratios (4, 6, 8, and 16), according to an embodiment.

FIG. 11A is a graph of energy release by Al/CuO core-shell nanoparticles at different equivalence ratios and $NH_3$/Cu ratios, according to an embodiment. FIG. 11B is a graph of onset temperature by Al/CuO core-shell nanoparticles at different equivalence ratios and $NH_3$/Cu ratios, according to an embodiment. FIG. 11C is a graph of peak temperature of major exothermic peak by Al/CuO core-shell nanoparticles at different equivalence ratios and $NH_3$/Cu ratios, according to an embodiment. FIG. 11A shows the energy release for the $NH_3$/Cu ratios and ERs represented in FIGS. 10A and B. FIG. 11B shows the onset temperature of the reaction for the $NH_3$/Cu ratios and ERs represented in FIGS. 10A and 10B. FIG. 11C shows the peak temperature of the main reaction for the $NH_3$/Cu ratios and ERs represented in FIGS. 10A and 10B.

DSC measurements of all the produced Al/CuO samples with different equivalence ratios (ER) and $NH_3$/Cu ratios were carried out to analyze the energetic reaction pathways and potentials, as shown in FIGS. 10A and 10B. The numbers of the energy release in FIGS. 10A and 10B indicate the energy release of an exact curve instead of the average number for the corresponding sample. The key parameters, including energy release, onset, and the peak temperature of the main reaction, are of interest as they assist in determining the energetic reaction pathway and composite structure. The curves are shown in FIGS. 11A, 11B, and 11C.

FIG. 10A compares the representative curves of the samples with different ER at a fixed $NH_3$/Cu ratio of 6. Curves 1001, 1002, 1003, 1004 and 1005 represent ERs of 1.5, 2.0, 2.5, 3.0, and 4.0, respectively. All curves showed the main reaction peak between 520 to 660° C. The main reaction occurred under the melting point of Al (665° C.), indicating the reaction was in condensed phase. The detailed reaction pathway is hypothesized to be triggered by the diffusion of Al core out of the $Al_2O_3$ shell through the formed cracks during its crystallization from the amorphous phase to γ phase at 350° C. The diffusing-out Al core may contact the CuO shell, creating local hot spots and promoting the diffusion of Al core, thus accelerating the reaction. The samples with ER at 2.5 and 3.0 gave the highest energy release. In samples with lower ER, a second exothermal reaction shoulder can be found between 680 to 800° C., possibly resulting from the reaction between the excessive CuO with the as-produced co-oxidizer. The second reaction was very small compared to the main reaction peak, indicating most of the material has reacted before the melting of Al.

FIG. 10B shows different NH3/Cu ratios at a fixed ER of 3.0. Curves 1006, 1007, 1008, 1009, and 1010 represent NH3/Cu ratios of 4, 6, 8, 16, and reference sample of Al/CuO, respectively. For regular ultrasonically mixed samples, the reaction lasted until about 690° C., indicating that part of the reaction occurs after the melting of Al nanoparticles due to the physical distance between Al and CuO nanoparticles. The main reaction peak shown in the DSC curves of Al/CuO core-shell nanoparticles in FIGS. 10A and 10B were all completed before the melting of Al at 660° C., indicating a condensed-phase reaction between fuel and oxidizer for the main reaction. The sample prepared using slightly excessive ammonia (NH3/Cu) showed the highest energy release for the samples with the same ER at 3.0, which also occurred for samples with other ER, as shown in FIG. 11. When ammonia was slightly excessive compared to copper, Al and Cu(NH3) 42+ presented enough surface charge to self-assemble into core-shell structures, while there was not too much water to react with and deactivate the Al nanoparticles. When the NH3/Cu ratio was too high, the water from the ammonia aqueous solution could result in partly deactivation of the aluminum core during synthesis. Therefore, when NH3/Cu ratio is 6, a good core-shell Al/CuO nanoparticle was formed while the deactivation of Al was minimal, leading to its highest energy release. A discrete second peak can be seen in 6B when NH3/Cu ratio is high for Al/CuO core-shell samples. The reaction possibly resulted from the reaction between the unreacted CuO and the Al—Cu co-oxidizer after the main reaction, or between the unreacted CuO and the unreacted Al core, which was trapped inside the thickened Al2O3 shell caused by excess water during synthesis.

Compared to Al/CuO mixed by ultrasonication, the core-shell Al/CuO nanoparticle did not show higher energy release, as shown in FIG. 11A. However, the characteristic temperature of the reaction did change significantly. Apart from the complete temperature of the main reaction, which was discussed earlier, the onset and peak temperatures of the main reaction were also reduced. The decrease of onset temperature was relatively minor, only about 3-10° C., indicating that the triggering mechanism of the exothermal reaction remained unchanged. However, due to the proximity of fuel and oxidizer in the Al/CuO core-shell structure, the peak temperature of the reaction decreased significantly. Once the diffusion of Al occurred, the reactive fuel could easily get into contact with the oxidizer without traveling a longer distance, resulting in a reduction of peak temperature for 10-25° C. Although a better core-shell structure was formed when ammonia was in excess, it did not conclusively result in lower onset or peak temperature all the time, since the extra water from the ammonia deactivated part of the Al, thickening the $Al_2O_3$ shell and increasing these numbers.

The reaction parameters of the main reaction of the as-fabricated core-shell Al/CuO nanostructure are compared to other Al/CuO structures, as shown in Table 3 below. The as-fabricated Al/CuO core-shell nanoparticle in this work showed the second-lowest onset and peak temperature, only higher than the first peak of another Al/CuO core-shell structure reported by Shi et al. The proximity of fuel and oxidizer in the core-shell structure led to the initiation of the reaction at a lower temperature. Moreover, most reactions showed multiple exothermal peaks, indicating the occurrence of different reaction pathways during heating, which was resulted from either the inhomogeneity of the sample or large Al particles. However, the core-shell Al/CuO presented here, and in our previous research, presented a single dominating exothermal peak that ends before the melting of Al, indicating the formation of a homogeneous core-shell structure and condensed-phase reaction between fuel and oxidizer. In terms of energy release, the nanoparticle Al/CuO did not show improvement compared to the samples with multiple exothermal peaks, possibly due to the partly deactivation of Al by the water during synthesis. However, please note that the energy release of the reaction might be calculated in different ways by different researchers.

TABLE 3

Comparison of onset, peak, end temperature, and energy release of Al/CuO with different structures and synthesis methods. The symbol "~" indicates the number was not directly given in the paper and was measured based on the DSC curve.

| Structure/Synthesis method | Onset temperature | Peak temperature | End temperature | Max total energy release |
|---|---|---|---|---|
| Physical Mixture Al(1.5 μm)/CuO(200 nm) & Al(100 nm)/CuO(200 nm) [37] | ~560° C. (Micro-Al)<br>~620° C. (Nano-Al) | 642° C. (Micro-Al)<br>650° C. (Nano-Al) | ~720° C. (Micro-Al)<br>~680° C. (Nano-Al) | 2169 J/g (Micro-Al)<br>537 J/g (Nano-Al) |
| Physical Mixture Al(30-100 nm)/ CuO(nanorod) [38] | ~550° C.<br>~750° C. | 604° C.<br>~795° C. | 657° C.<br>~830° C. | 1835 J/g (two peaks) |
| Assembled Al(~100 nm)/CuO (nanorod) with graphene [39] | ~580° C. | 595° C.<br>680-710° C. | 695-725° C. | 1679 J/g (two peaks) |
| Assembled Al(100 nm)/CuO(50 nm) with peptide [40] | ~550° C. | 663° C. | 750° C. | 2070 J/g (two peaks) |
| Sputtered core/shell CuO-nanorod/Al & CuO-nanotube/Al [41] | 582° C. (rod)<br>582° C. (tube)<br>730° C. (tube) | 620° C. (rod)<br>625° C. (tube)<br>730° C. (tube) | 660° C. (rod)<br>660° C. (tube)<br>770° C. (tube) | 1977 J/g (rod)<br>2281 J/g (tube)<br>(two peaks) |
| Spherical core/shell Al(1 μm)/CuO [29] | ~580° C. | ~620° C. | 655° C. | 807 J/g |
| Spherical core/shell Al(0.5-5 μm)/CuO [36] | ~520° C.<br>~700° C. | ~560° C.<br>~730° C. | ~800° C. | 832 J/g |
| Spherical core/shell Al(100 nm)/CuO (this work) | 555 ± 5° C. | 580 ± 10° C. | 655° C. | 1566 J/g |

In some examples, metal oxides, or oxide precursors may be sourced from Earth. Such sources may include recycling space debris, satellites in orbit, or other materials transported from Earth to space. In other examples, metal oxides, or oxide precursors may be sourced from space. Such sources may include the Moon (lunar regolith), Mars (martian regolith), and or asteroid sources.

In some examples, the systems and methods described herein may be modified to produce energetic core-shell particles with different properties, such as different core shell structures. Such core shell structures may include core-shell, multi-core shell, multi-core hollow structure, yolk shell, multi-core hollow, core mesopores, sandwiched core shell, and embedded structures. In other examples, core shell structures or arrangements may include core-shell, double shell, multi-shell, concentration gradient, and full concentration gradient.

Thermite mixtures, including micro thermites, nano thermites, micro energetic core-shell particles, and nano energetic core-shell particles, such as those described, and synthesized by the methods and systems herein, may be applied to a number of uses requiring high density stored energy, high intensity energy, low carbon emission energy or combustion sources, remote operations (including earth orbit and outer space), and other requirements.

In some examples, a metal may be combined with an oxidizer, for example, air and/or water. The oxidizer may be used as the carrier, and as the source of oxidation of the metal. In other examples the fuel and oxidizer, in the form of a thermite, may both be located in the same metallic particle (for example a metal oxide coat on the outside of a metal particle). In some examples, these particles may be referred to as metallic fuels (such as metal, metallic, and/or energetic particles, thermites and/or micro, and/or nano-thermites, or the like).

Metallic materials may contain energetic particles which are made up of a fuel and an oxidizer-typically a metal and a metal oxide, respectively. Nano thermites are composed of both the oxidizer and fuel within each particle, and are on the scale of 100 nanometers or below. The energy release per mass of particle is very large. In an example, using metallic fuel propellant including nano thermites or micro thermites, or a combination thereof, may be combined with an inert carrier gas and or liquid or fluid to disperse the propellant within a chamber for effective heating and/or combustion, leading to well-controlled heating, construction, power and thrust generation.

Metallic materials and or fuels (e.g., thermites, micro thermites, nano thermites) have high energy density, and when mixed with an inert gas, liquid and/or carrier fluid, are generally safer to handle and transport than conventional fuels. They may be synthesized and manufactured, and transported to be used and/or stored for future use. Propellants may be produced, stored and transported for dispatchable power. Stored energy may be in the form of materials. Fuels may be used to generate heat, for construction, power and propulsion applications.

In some examples, energetic core-shell particles may be used as sources for catalytic conversion of carbon dioxide (e.g. atmospheric carbon dioxide), such as thermocatalysis, photocatalysis and electrocatalysis processes for conversion of carbon dioxide to produce products such as CO, $H_2$, $C_3OH$, $C_2$, and or CH, or other desired products derived from $CO_2$ conversion processes. In some examples, energetic core-shell particles may be used as sources for catalytic conversion of methane. In other examples, energetic core-shell particles may be used as sources for catalytic conversion of other greenhouse gases.

In some examples, nano thermites may be used for propulsion, power generation, energy storage, and energy distribution. In some examples, nano thermites may be used for construction, including welding, additive manufacturing, and 3D printing, such as the inclusion core shells into materials for 3D printing to create 3D printable materials with user defined properties. In some examples, nano thermites may be used as battery cathodes. In some examples, nano thermites may be used as filters, such as mesh filters, comprising specific geometry which may specifically target certain particles, such that these certain particles may not pass through the filter, or vice versa.

In some examples, nano thermites may be used in a thermal control system as described in Patent Application WO2022140864A1 to Oqab and Dietrich, incorporated herein by reference.

In some examples, nano thermites may be applied to ignitor systems, wherein nano thermites are heated with a laser or induction heating system to initiate the ignition of another substance. Such an ignitor may be more portable and appropriately disposable than other ignitor systems.

In some examples, a spacecraft may synthesize energetic particles which may be applied to ignitor systems, wherein energetic particles are heated with a laser or induction heating system to initiate the ignition of another substance. The spacecraft may rendezvous and attach to an uncontrolled object in space such as a space junk, space debris, satellites at the end of their life-cycle, satellites that have ran out of fuel, second stages, asteroids or other space objects to provide motility and/or additional propulsion capabilities.

In some examples, a spacecraft may transport a plurality of other spacecrafts for operations, logistics, maintenance, transportation from point to and or orbit raising.

In some examples, a plurality of satellites can be launched and deployed in low earth orbit to help clean up space debris and space traffic management using a laser assisted ignition system and energetic particles. Assistance in ignition can be provided with a laser and/or induction heating system. A subsystem satellite with a deployable plate comprising a first layer of weld filler and/or energetic particles, and/or a second layer with energetic particles, may be used to serve as a catalyst which may be ignited using a laser and/or induction heating assisted ignition. The deployable plate can be ignited at a distance using a plurality of other satellites at different orbits. In other implementations, the ignition may occur from a plurality of fixed and mobile sources on the ground, in the air (e.g. from drones and/or airships), on water, and/or in space.

In an implementation, to capture and release an uncontrollable space object, including but not limited to space debris, satellites with no propulsion system, may capture second stages or other space objects larger than 10 cm, or asteroids, enabling the uncontrollable space object to be equipped with a new propulsion system and/or be refueled or undergo in-orbit servicing.

In other implementations, energetic particles may be used in conjunction with a plurality of shaping methods including but not limited to microemulsion, wet-spinning, roll-to-roll casting, spin-coating, and or molding. In some implementations, shapes such microspheres, fibers, sheets, coatings, complex shapes, layered shapes, and/or monoliths can be created.

In other implementations, energetic core-shells may be used in addition to molecular precursor, nanoparticles, nanofibers, nanotubes, nanosheets or the like. In some examples, microstructures may be added, such as particle chains, fibrous structures and/or stacked flake structures.

In other implementation, the satellite system may carry a plurality of other satellites for in-space applications and services. In some implementations, the satellite subsystem may be onboard a refueling satellite system, which may capture, and refuel other satellites in space for servicing, and release these satellites for continuous operation or services beyond Low Earth Orbit.

In some examples, energetic core-shell particles may embedded into the structure of systems, under a reaction, and/or sintering and hardening process.

In some examples, energetic core-shell particles may be reacted in gas, for the application of propulsion, by heating and expanding this gas, generating thrust.

In some examples, energetic core-shell particles may be applied to space based applications, such as space manufacturing, for products such as synthesizing compounds and mixtures that benefit from the microgravity environment and result in an improved conditions such as production of materials related to pharmaceutical drugs and/or other medical applications.

In some examples, energetic core-shell particles may be applied to drive reactions on Earth and or in Space.

In some examples, energetic core-shell particles may be applied to refueling of satellites in space. In some examples, magnetic fuels can be added to materials to make them more magnetic and enable mobile particles in varied gravity, particles can be moved within a system using magnetohydrodynamics. Magnetic properties of the fuel may be used to replenish systems in space.

While the above description provides examples of one or more apparatus, methods, or systems, it will be appreciated that other apparatus, methods, or systems may be within the scope of the claims as interpreted by one of skill in the art.

The invention claimed is:

1. A method for controllable synthesis of energetic nanocomposites, the method comprising:

dispersing a reductive fuel within a first aqueous solution to create a reductive fuel solution;

combining a metal oxide and a base as a second aqueous solution, at a specific ratio of metal oxide to base, to create a metal oxide-base complex solution;

mixing the reductive fuel solution and the metal oxide-base complex solution together to create a reductive fuel-metal oxide/base solution;

filtering precipitated solid material from the reductive fuel-metal oxide/base solution; and heating the solid material to obtain reductive fuel-metal oxide energetic nanocomposites, wherein the structure and energetic performance characteristics of the reductive fuel-metal oxide energetic nanocomposites depend on the specific ratio of the metal oxide to base in the metal oxide-base complex solution.

2. The method of claim 1 wherein the specific ratio is a first ratio wherein the base is in excess of the metal oxide and wherein the reductive fuel-metal oxide energetic nanocomposites have a core-shell structure where the reductive fuel is the core and the metal oxide is the shell.

3. The method of claim 1 wherein the specific ratio is a second ratio wherein the base in not in excess of the metal oxide and wherein the reductive fuel-metal oxide energetic nanocomposites have a well-mixed structure.

4. The method of claim 1 wherein the reductive fuel is aluminum nanoparticles.

5. The method of claim 1 wherein the metal oxide is copper oxide.

6. The method of claim 1 wherein the base is ammonia.

7. The method of claim 1 wherein the first aqueous solution is ethanol.

8. The method of claim 1 wherein the metal oxide is provided as an oxide precursor.

9. The method of claim 1 wherein the metal oxide is sourced from regolith.

10. The method of claim 1 wherein the reductive fuel is sourced from regolith.

11. A system for mass, controllable synthesis of energetic nanocomposites, the system comprising:

a disperser to disperse reductive fuel within a first aqueous solution to create a reductive fuel solution;

a mixer to mix the reductive fuel solution with a metal oxide-base complex solution to create a reductive fuel-metal oxide/base solution, wherein a specific ratio of metal oxide to base can be altered;

a filter to collect solid material from the reductive fuel-metal oxide/base solution; and a heat source to heat the solid material to obtain reductive fuel-metal oxide energetic nanocomposites, wherein a structure of the reductive fuel-metal oxide energetic nanocomposites depends on the ratio of the metal oxide-base in the metal oxide-base complex solution.

12. The system of claim 11 wherein the specific ratio is a first ratio wherein the base is in excess of the metal oxide and wherein the reductive fuel-metal oxide energetic nanocomposites have a core-shell structure where the reductive fuel is the core and the metal oxide is the shell.

13. The system of claim 11 wherein the specific ratio is a second ratio wherein the base in not in excess of the metal oxide and wherein the reductive fuel-metal oxide energetic nanocomposites have a well-mixed structure.

14. The system of claim 11 wherein the reductive fuel is aluminum nanoparticles.

15. The system of claim 11 wherein the metal oxide is copper oxide.

16. The system of claim 11 wherein the base is ammonia.

17. The system of claim 11 wherein the first aqueous solution is ethanol.

18. The system of claim 11 wherein the metal oxide is provided as an oxide precursor.

19. The system of claim 11 wherein the metal oxide is sourced from regolith.

20. The system of claim 11 wherein the reductive fuel is sourced from regolith.

* * * * *